US009585203B2

(12) United States Patent
Sadahira et al.

(10) Patent No.: US 9,585,203 B2
(45) Date of Patent: Feb. 28, 2017

(54) MICROWAVE HEATING DEVICE

(75) Inventors: Masafumi Sadahira, Shiga (JP); Daisuke Hosokawa, Shiga (JP); Koji Yoshino, Shiga (JP); Tomotaka Nobue, Nara (JP); Yoshiharu Omori, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 586 days.

(21) Appl. No.: 14/237,094

(22) PCT Filed: Jul. 31, 2012

(86) PCT No.: PCT/JP2012/004866

§ 371 (c)(1),
(2), (4) Date: Feb. 4, 2014

(87) PCT Pub. No.: WO2013/018358

PCT Pub. Date: Feb. 7, 2013

(65) Prior Publication Data

US 2014/0166645 A1 Jun. 19, 2014

(30) Foreign Application Priority Data

Aug. 4, 2011 (JP) ..... 2011-170676
Nov. 18, 2011 (JP) ..... 2011-252552

(51) Int. Cl.
*H05B 6/72* (2006.01)
*H05B 6/70* (2006.01)

(52) U.S. Cl.
CPC ..... *H05B 6/72* (2013.01); *H05B 6/70* (2013.01); *H05B 6/708* (2013.01)

(58) Field of Classification Search
CPC . H05B 6/708; H05B 6/70; H05B 6/72; H05B 6/707; H05B 6/725; H05B 6/806; H05B 6/78; H05B 6/74; H01Q 21/0043
(Continued)

(56) References Cited

U.S. PATENT DOCUMENTS 2,605,413 A * 7/1952 Alvarez ..... H01Q 3/32 333/248
2,704,802 A * 3/1955 Blass ..... H05B 6/72 219/691
3,210,511 A * 10/1965 Smith ..... H05B 6/6426 219/746
3,373,259 A * 3/1968 Smith ..... H05B 6/6411 219/746
3,643,262 A * 2/1972 Dumanchin ..... H01Q 13/206 343/708

(Continued)

FOREIGN PATENT DOCUMENTS

CH 684373 A5 8/1994
CN 1231397 A 10/1999

(Continued)

OTHER PUBLICATIONS

Extended European Search Report in corresponding European Application No. 12820411.2, dated Dec. 9, 2014, 6 pages.

(Continued)

*Primary Examiner* — Eric Stapleton
(74) *Attorney, Agent, or Firm* — Brinks Gilson & Lione

(57) ABSTRACT

In a microwave heating device of the present invention, a heating-chamber input portion is adapted to direct, to a heating chamber, microwaves having propagated through a waveguide tube and having passed through the positions where microwave radiating portions are formed, thereby realizing a state where progressive waves are dominant among the microwaves propagating through the waveguide tube, so that the microwave radiating portions are caused to radiate, to the inside of the heating chamber, microwaves based on the progressive waves propagating through the waveguide tube. This enables uniformly heating an object to be heated, without using a rotational mechanism.

20 Claims, 16 Drawing Sheets

(58) Field of Classification Search
USPC ..... 219/690, 747, 748, 750, 756; 333/157, 333/208–212, 248
See application file for complete search history.

(56) References Cited

U.S. PATENT DOCUMENTS

| | | | | | |
|---|---|---|---|---|---|
| 3,819,900 | A * | 6/1974 | Ironfield | H01P 1/16 | 219/746 |
| 3,909,754 | A * | 9/1975 | Chapell | H01P 1/212 | 219/708 |
| 4,079,221 | A * | 3/1978 | McGillem | H01P 1/182 | 219/747 |
| 4,099,042 | A * | 7/1978 | Jean | B01J 19/12 | 219/696 |
| 4,107,501 | A * | 8/1978 | Ironfield | H05B 6/6402 | 219/710 |
| 4,129,872 | A * | 12/1978 | Toman | H01Q 3/245 | 343/768 |
| 4,144,436 | A * | 3/1979 | Hauck | H05B 6/74 | 219/746 |
| 4,160,144 | A * | 7/1979 | Kashyap | H01Q 13/22 | 219/691 |
| 4,160,145 | A * | 7/1979 | Rueggeberg | H05B 6/78 | 219/691 |
| 4,301,347 | A * | 11/1981 | Quine | H05B 6/74 | 219/747 |
| 4,370,534 | A * | 1/1983 | Brandon | A01M 1/226 | 219/695 |
| 4,399,341 | A * | 8/1983 | Yasuoka | H01Q 13/20 | 219/691 |
| 4,406,937 | A * | 9/1983 | Soulier | F26B 3/347 | 219/686 |
| 4,414,453 | A * | 11/1983 | Simpson | H05B 6/725 | 219/749 |
| 4,421,968 | A * | 12/1983 | Osepchuk | H05B 6/642 | 219/746 |
| 4,446,349 | A * | 5/1984 | Smith | H05B 6/74 | 219/747 |
| 4,642,435 | A * | 2/1987 | Fitzmayer | H05B 6/72 | 219/749 |
| 4,684,776 | A * | 8/1987 | Heard | H05B 6/80 | 134/1 |
| 4,746,968 | A * | 5/1988 | Wear | A23L 3/54 | 219/685 |
| 4,808,784 | A * | 2/1989 | Ko | H05B 6/707 | 219/746 |
| 4,992,762 | A * | 2/1991 | Godshalk | H01P 5/10 | 333/239 |
| 5,567,339 | A * | 10/1996 | Joo | H05B 6/70 | 219/697 |
| 5,924,120 | A * | 7/1999 | Razdan | G06F 9/3869 | 711/141 |
| 5,948,310 | A * | 9/1999 | Shon | H05B 6/704 | 219/695 |
| 6,034,362 | A * | 3/2000 | Alton | H05B 6/704 | 219/745 |
| 6,097,018 | A * | 8/2000 | Kim | H05B 6/704 | 219/695 |
| 6,172,348 | B1 * | 1/2001 | Yoshino | H05B 6/6411 | 219/704 |
| 6,384,392 | B1 * | 5/2002 | Lee | A47J 36/027 | 219/725 |
| 6,396,037 | B1 * | 5/2002 | Rossouw | B65D 65/14 | 156/180 |
| 6,590,192 | B2 * | 7/2003 | Taino | H05B 6/6455 | 219/710 |
| 6,649,890 | B1 * | 11/2003 | Brinker | H05B 6/6482 | 219/681 |
| 6,667,466 | B1 * | 12/2003 | Whipple, Jr. | H05B 6/705 | 219/746 |
| 6,680,467 | B1 * | 1/2004 | Whipple, Jr. | H05B 6/6402 | 219/697 |
| 6,828,533 | B2 * | 12/2004 | Hayami | H05B 6/6494 | 219/730 |
| 7,067,779 | B2 * | 6/2006 | Mulcahy | H01J 23/40 | 219/690 |
| 7,554,054 | B2 * | 6/2009 | Takada | H01J 37/32192 | 219/121.4 |
| 8,222,579 | B2 * | 7/2012 | Taguchi | H05B 6/701 | 204/157.15 |
| 8,294,071 | B2 * | 10/2012 | Taguchi | H05B 6/701 | 204/157.15 |
| 8,492,686 | B2 * | 7/2013 | Bilchinsky | H05B 6/688 | 118/723 E |
| 8,653,482 | B2 * | 2/2014 | Ben-Shmuel | H05B 6/6402 | 204/298.38 |
| 8,803,051 | B2 * | 8/2014 | Lee | H05B 6/708 | 219/746 |
| 8,839,527 | B2 * | 9/2014 | Ben-Shmuel | D06F 58/266 | 34/255 |
| 8,847,130 | B2 * | 9/2014 | Niwa | H05B 6/802 | 123/142.5 E |
| 8,941,039 | B2 * | 1/2015 | Galbreath | H05B 6/6402 | 219/681 |
| 9,040,884 | B2 * | 5/2015 | Han | H01L 21/67115 | 219/411 |
| 2003/0102307 | A1 * | 6/2003 | Kang | H05B 6/6402 | 219/746 |
| 2003/0136519 | A1 * | 7/2003 | Sumida | H01J 37/32183 | 156/345.44 |
| 2005/0173422 | A1 * | 8/2005 | Kato | H05B 6/6402 | 219/695 |
| 2005/0212626 | A1 * | 9/2005 | Takamatsu | H05B 6/806 | 333/212 |
| 2006/0081624 | A1 * | 4/2006 | Takada | H01J 37/32192 | 219/716 |
| 2006/0124635 | A1 * | 6/2006 | Risman | H05B 6/6402 | 219/690 |
| 2006/0289526 | A1 * | 12/2006 | Takizaki | H05B 6/6402 | 219/746 |
| 2007/0068937 | A1 * | 3/2007 | Risman | H05B 6/704 | 219/693 |
| 2007/0194011 | A1 * | 8/2007 | McFadden | A21B 1/245 | 219/681 |
| 2008/0087662 | A1 * | 4/2008 | Takizaki | H05B 6/6402 | 219/678 |
| 2008/0272114 | A1 * | 11/2008 | Taguchi | H05B 6/701 | 219/690 |
| 2009/0321427 | A1 * | 12/2009 | Hyde | H05B 6/6455 | 219/702 |
| 2011/0031239 | A1 * | 2/2011 | Taguchi | H05B 6/701 | 219/745 |
| 2012/0181267 | A1 * | 7/2012 | Kimrey, Jr. | H05B 6/701 | 219/756 |

FOREIGN PATENT DOCUMENTS

| | | | |
|---|---|---|---|
| CN | 1778146 | A | 5/2006 |
| DE | 200 06 527 | U1 | 11/2000 |
| EP | 1 619 933 | A1 | 1/2006 |
| JP | 60-003595 | U | 1/1985 |
| JP | 61-127595 | U | 8/1986 |
| JP | 62-064093 | A | 3/1987 |
| JP | 63-279596 | A | 11/1988 |
| JP | 9-22775 | A | 1/1997 |
| JP | 2003-173867 | A | 6/2003 |
| JP | 2005-203230 | A | 7/2005 |
| JP | 2005-268624 | A | 9/2005 |

OTHER PUBLICATIONS

Office Action in corresponding European Application No. 12820411.2, dated Dec. 2, 2015, 4 pages.

International Search Report for International Application No. PCT/JP2012/004866, dated Sep. 4, 2012, 2 pages.

International Preliminary Report on Patentability for International Application No. PCT/JP2012/004866, dated Feb. 4, 2014, 5 pages.

(56) References Cited

OTHER PUBLICATIONS

Office Action and Search Report, and partial translation thereof, in corresponding Chinese Application No. 201280038142.6, dated Feb. 13, 2015, 8 pages.

* cited by examiner

MICROWAVE HEATING DEVICE

This application is a 371 application of PCT/JP2012/004866 having an international filing date of Jul. 31, 2012, which claims priority to JP 2011-170676 filed Aug. 4, 2011 and JP 2011-252552 filed Nov. 18, 2011, the entire contents of which are incorporated herein by reference.

TECHNICAL FIELD

The present invention relates to microwave heating devices such as microwave ovens and, more particularly, relates to microwave heating devices having characteristic structures for radiating microwaves to insides of heating chambers.

BACKGROUND ART

As representative apparatuses among microwave heating devices for performing heating processing on objects to be heated through microwaves, there are microwave ovens. A microwave oven is adapted to radiate microwaves generated from microwave supply means to the inside of a metal heating chamber, thereby causing an object to be heated within the heating chamber to be subjected to heating processing through radiated microwaves.

Conventional microwave ovens have employed magnetrons as such microwave supply means. Such a magnetron generates microwaves, which are radiated to the inside of the heating chamber from microwave radiating portions through a waveguide tube. A non-uniform microwave electromagnetic-field distribution (microwave distribution) within the heating chamber presents a problem in that uniform microwave heating of the object cannot be heated.

As means for uniformly heating an object to be heated within a heating chamber, there is a structure adapted to rotate a table for placing the object to be heated on the table for rotating the object to be heated within the heating chamber, a structure adapted to rotate an antenna for radiating microwaves while fixing the object to be heated, or a structure adapted to shift the phase of microwaves from microwave supply means using a phase shifter. Microwave heating devices including these structures have been generally used.

For example, some conventional microwave heating devices have been structured to have a rotatable antenna and an antenna shaft which are placed within a waveguide tube and, further, to drive a magnetron while rotating this antenna through a motor, thereby alleviating the non-uniformity in the microwave distribution within the heating chamber.

Further, Unexamined Japanese Patent Publication No. S 62-64093 (Patent Literature 1) describes a microwave heating device having a different structure. This Patent Literature 1 suggests a microwave heating device which is provided with a rotatable antenna at an upper portion of a magnetron and is adapted to direct air flows from a blower fan to the blades of this antenna for rotating the antenna by the wind power from the blower fan, in order to change the microwave distribution within the heating chamber.

As an example of provision of such a phase shifter, U.S. Pat. No. 4,301,347 (Patent Literature 2) describes a microwave heating device which is adapted to alleviate heating unevenness in an object to be heated through microwave heating and to reduce the cost and the space of feeding portions. This Patent Literature 2 suggests a microwave heating device having a single microwave radiating portion for radiating circularly-polarized waves within a heating chamber.

Patent Literature 1: Unexamined Japanese Patent Publication No. S 62-064093

Patent Literature 2: U.S. Pat. No. 4,301,347

SUMMARY OF THE INVENTION

Technical Problem

Microwave heating devices having conventional structures as described above have been required to have a simplest possible structure and to be capable of heating objects to be heated with higher efficiency and with no unevenness. However, conventional structures which have been ever suggested have not been satisfied and have had various problems in terms of structures, efficiency and uniformity.

Further, there has been advancement of technical developments for increasing the outputs of microwave heating devices, particularly microwave ovens, and products with a rated high-frequency output of 1000 W have been commercialized domestically. As products, microwave ovens have the significant property of having convenience of directly heating foods using induction heating, rather than heating foods using heat conduction. However, in a state where non-uniform heating has not been overcome in such microwave ovens, there has been a significant problem in that increasing of outputs makes such non-uniform heating more manifest.

Conventional microwave heating devices have had the problems in structure, as the following two points.

The first point is as follows. In order to alleviate non-uniform heating, there has been a need for a driving mechanism for rotating a table or an antenna. This requires securing a space for rotation and an installation space for a driving source such as a motor for rotating the table or antenna, and therefore, size reduction of microwave ovens is obstructed.

The second point is as follows. In order to stably rotate the table or the antenna, it is necessary to provide this antenna at an upper portion or a lower portion in the heating chamber, and therefore, the placement of particular members in the structure is restricted.

In microwave heating devices, installation of a rotation mechanism for a table or a phase shifter within the microwave radiation chamber degrades reliability. Therefore, there has been a need for microwave heating device which eliminate the necessity of such mechanisms.

Further, even the microwave heating device described in Patent Literature 2, which is adapted to alleviate non-uniform heating (heating unevenness) in an object to be heated through microwave heating and to reduce the fabrication cost and the space of feeding portions, has problems as follows. The microwave heating device having a single microwave radiating portion for radiating circularly-polarized waves to the inside of the heating chamber, which is disclosed in Patent Literature 2, has the advantage of having no rotational mechanism, but has the problem in that sufficiently-uniform heating through microwave heating cannot be realized.

The present invention was made to overcome the aforementioned problems in conventional techniques and aims at providing a microwave heating device capable of uniform microwave heating of an object to be heated, without using a rotational mechanism.

Solution to Problem

A microwave heating device according to one aspect of the present invention comprises a heating chamber adapted to house an object to be heated; a microwave supply portion for supplying microwaves to the heating chamber; a waveguide tube for propagating microwaves supplied from the microwave supply portion, to the heating chamber; a plurality of microwave radiating portions which are formed on the waveguide tube and are for radiating microwaves propagating through the waveguide tube, to inside of the heating chamber; and a heating-chamber input portion which is adapted to direct, to the inside of the heating chamber, microwaves having propagated through the waveguide tube and having passed through positions where the microwave radiating portions are formed, to realize a state where a progressive wave is dominant, among the microwaves propagating through the waveguide tube; wherein the microwave radiating portions are adapted to radiate, to the inside of the heating chamber, microwaves based on the progressive wave propagating through the waveguide tube. With the structure of the microwave heating device having the aforementioned structure in one aspect of the present invention, it is possible to perform uniform microwave heating on an object to be heated, without using a rotational mechanism.

Advantageous Effects of Invention

With the present invention, there is provided a structure for causing progressive waves being changed in amplitude to pass through the positions where the microwave radiating portions are formed, within the waveguide tube, so that microwaves are dispersedly radiated from the opening portions dispersed at the plurality of positions while the amounts of radiations of the microwaves are changed. This enables provision of a microwave heating device capable of uniform microwave heating of an object to be heated, without using a rotational mechanism.

DETAILED DESCRIPTION OF THE PREFERRED EMBODIMENTS

Figure 1:
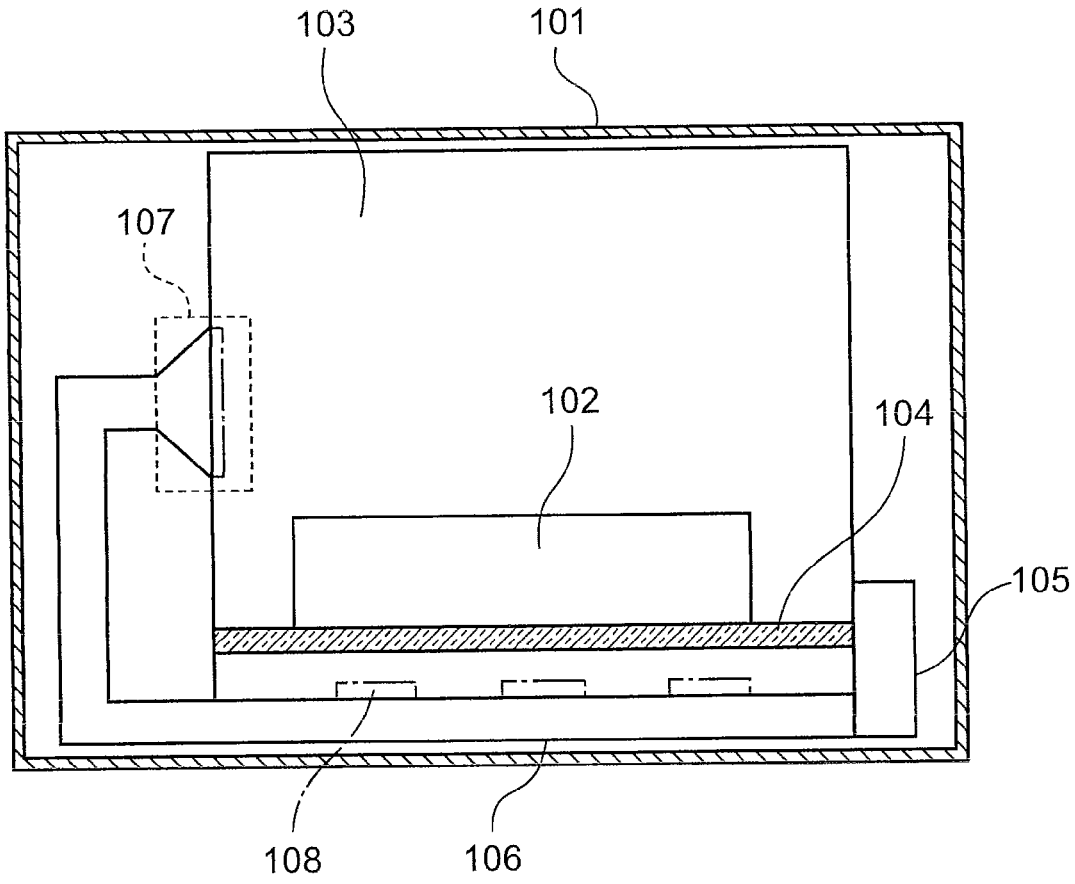
FIG. 1 is a schematic cross-sectional view of a microwave heating device according to a first embodiment of the present invention.

A microwave heating device according to a first aspect of the present invention comprises a heating chamber adapted to house an object to be heated; a microwave supply portion for supplying microwaves to the heating chamber; a waveguide tube for propagating microwaves supplied from the microwave supply portion, to the heating chamber; a plurality of microwave radiating portions which are formed on the waveguide tube and are for radiating microwaves propagating through the waveguide tube, to inside of the heating chamber; and a heating-chamber input portion which is adapted to direct, to the inside of the heating chamber, microwaves having propagated through the waveguide tube and having passed through positions where the microwave radiating portions are formed, to realize a state where a progressive wave is dominant, among the microwaves propagating through the waveguide tube; wherein the microwave radiating portions are adapted to radiate, to the inside of the heating chamber, microwaves based on the progressive wave propagating through the waveguide tube.

The microwave heating device having the aforementioned structure in the first aspect of the present invention is adapted to direct microwaves to the inside of the heating chamber through the heating-chamber input portion, at the termination end of the waveguide tube in the microwave propagation direction. Therefore, the microwave heating device in the first aspect of the present invention is enabled to radiate microwaves to the inside of the heating chamber, through the microwave radiating portions provided in the waveguide tube, in such a way that the microwave propagation state within the waveguide tube is a state where a progressive wave is dominant while there are less standing wave. This enables efficiently heating the object to be heated. Accordingly, with the present invention, a progressive wave being changed in amplitude is caused to pass through the positions where the microwave radiating portions are formed, within the waveguide tube, so that microwaves are dispersedly radiated through the opening portions dispersed at the plurality of positions while the amounts of radiations of the microwaves are changed. This enables provision of a microwave heating device capable of uniform microwave heating of an object to be heated, without using a rotational mechanism.

The microwave heating device according to a second aspect of the present invention, wherein the plurality of the microwave radiating portions in the first aspect are placed symmetrically with respect to a center of the heating chamber. The microwave heating device having this structure in the second embodiment is enabled to uniformly radiate microwaves, such that the amounts of radiations are symmetric with respect to the object to be heated within the heating chamber.

The microwave heating device according to a third aspect of the present invention, which is adapted such that an amount of microwaves input to the inside of the heating chamber through the heating-chamber input portion in the first or second aspect is equal to or less than 10% of a total amount of microwaves radiated to the inside of the heating chamber through the plurality of the microwave radiating portions. With the microwave heating device having this structure in the third aspect, it is possible to secure a larger amount of microwaves to be used for heating the object to be heated, and, also, it is possible to make a progressive wave dominant, among microwaves propagating through the waveguide tube.

The microwave heating device according to a fourth aspect of the present invention, wherein surfaces forming the heating chamber in any one aspect of the first to third aspects are adapted such that a surface in which the heating-chamber input portion is placed, and a surface in which the microwave radiating portions are placed, are facing each other. The microwave heating device having this structure in the fourth aspect is enabled to uniformly heat the object to be heated from one surface of the heating chamber, while heating the object to be heated from the other surface.

The microwave heating device according to a fifth aspect of the present invention, wherein the heating-chamber input portion in any one aspect of the first to third aspects comprises a reflective-surface structural portion formed in a termination end of the waveguide tube in a microwave propagation direction, and an inputting opening portion adapted to direct, to the inside of the heating chamber, microwaves having been reflected by the reflective-surface structural portion. With the microwave heating device having this structure in the fifth aspect, it is possible to compactly form the heating-chamber input portion.

The microwave heating device according a sixth aspect of the present invention, wherein the microwave radiating portions in any one aspect of the first to fifth aspects are adapted to have a shape capable of radiating a circularly-polarized wave. With the microwave heating device having this structure in the sixth aspect, it is possible to perform uniform heating over a wider range, within the heating chamber.

The microwave heating device according to a seventh aspect of the present invention, wherein the heating-chamber input portion in any one aspect of the first, second, third and sixth aspects comprises a termination-end closure portion formed in a termination end of the waveguide tube in a microwave propagation direction, and a termination-end radiating portion adapted to direct, to the inside of the heating chamber, microwaves based on a standing wave having an in-tube wavelength which is induced in the termination-end closure portion, and a distance in the microwave propagation direction from the termination-end closure portion to a center of the termination-end radiating portion has a length of an odd multiple of about ¼ the in-tube wavelength in the waveguide tube. With the microwave heating device having this structure in the seventh aspect, since the position of the center of the termination-end radiating portion is placed at the position of an anti-node in standing waves generated based on the in-tube wavelength, it is possible to facilitate the ejection of microwaves through the termination-end radiating portion, thereby further enhancing progressive wave components of microwaves propagating through the waveguide tube.

The microwave heating device according to an eighth aspect of the present invention, wherein the heating-chamber input portion in any one aspect of the first, second, third and sixth aspects comprises a termination-end closure portion formed in a termination end of the waveguide tube in a microwave propagation direction, and a termination-end radiating portion adapted to direct, to the inside of the heating chamber, microwaves based on a standing wave having an oscillation wavelength of the microwave supply portion which is induced in the termination-end closure portion, and a distance in the microwave propagation direction from the termination-end closure portion to a center of the termination-end radiating portion has a length of an odd multiple of about ¼ the oscillation wavelength of the microwave supply portion.

The microwave heating device having the aforementioned structure in the eighth aspect is particularly effective, in cases of placing importance on the smaller-load heating performance, where the microwave heating device exhibits the property of causing microwaves having been once radiated through the microwave radiating portions to be returned to the inside of the waveguide tube from the heating chamber through the microwave radiating portions, while having the oscillation wavelength of the microwave supply portion. In cases of placing importance on the smaller-load heating performance, where the object to be heated absorbs a smaller amount of microwaves, since the position of the center of the termination-end radiating portion is placed at the position of an anti-node in the standing wave induced based on the wavelength being returned again to the inside of the waveguide tube from the heating chamber (the oscillation wavelength of the microwave supply portion), it is possible to facilitate the ejection of microwaves through the termination-end radiating portion, thereby further enhancing progressive wave components of microwaves propagating through the waveguide tube.

The microwave heating device according to a ninth aspect of the present invention, wherein the termination-end radiating portion in the seventh or eighth aspect is adapted to have a microwave ejecting function for ejecting microwaves propagating through the waveguide tube to the inside of the heating chamber and, also, to perform a function as a microwave radiating portion for heating the object to be heated. With the microwave heating device having the aforementioned structure in the ninth aspect, it is possible to effectively utilize the surfaces forming the heating chamber for uniformly heating the object to be heated, thereby enabling compactly forming the heating-chamber input portion.

Hereinafter, preferable embodiments of the microwave heating device according to the present invention will be described, with reference to the accompanying drawings. Further, the microwave heating devices according to the following embodiments will be described with respect to microwave ovens, but these microwave ovens are merely illustrative, and the microwave heating device according to the present invention is not limited to such microwave ovens and is intended to include microwave heating devices, such as heating devices, garbage disposers, semiconductor fabrication apparatuses which utilize induction heating. Further, the present invention is also intended to cover proper combinations of arbitrary structures which will be described in the following respective embodiments, wherein such combined structures exhibit their respective effects. Further, the present invention is not limited to the concrete structures of the microwave ovens which will be described in the following embodiments and is intended to cover structures based on similar technical concepts.

First Embodiment

FIG. 1 is a cross-sectional view schematically illustrating the structure of a microwave oven as a microwave heating device according to a first embodiment of the present invention. Referring to FIG. 1, "101" designates a casing, "102" designates an object to be heated, "103" designates a heating chamber for housing the object 102 to be heated in the chamber, "104" designates a placement portion for placing the object 102 to be heated on the portion, "105" designates a microwave supply portion for supplying microwaves to the heating chamber 103, "106" designates a waveguide tube for propagating, to the heating chamber 103, microwaves supplied from the microwave supply portion 105, "107" designates a heating-chamber input portion extended toward the heating chamber 103 from the termination end of the waveguide tube 106 in the microwave propagation direction, and "108" designates microwave radiating portions for radiating microwaves propagating through the waveguide tube 106, to the inside of the heating chamber 103.

Further, the placement portion 104 is constituted by a glass plate, the microwave supply portion 105 is constituted by a magnetron, the waveguide tube 106 is constituted by a rectangular waveguide tube, the heating-chamber input portion 107 is constituted by a horn-shaped opening portion adapted such that its cross-sectional shape orthogonal to the microwave propagation direction is gradually enlarged with decreasing distance to the heating chamber 103, and the microwave radiating portions 108 are constituted by opening portions formed from through holes formed in the surface shared between the waveguide tube 106 and the heating chamber 103 (the upper surface of the waveguide tube 106 in the first embodiment), which can easily realize the structure of the microwave oven as the microwave heating device according to the first embodiment.

Figure 2:
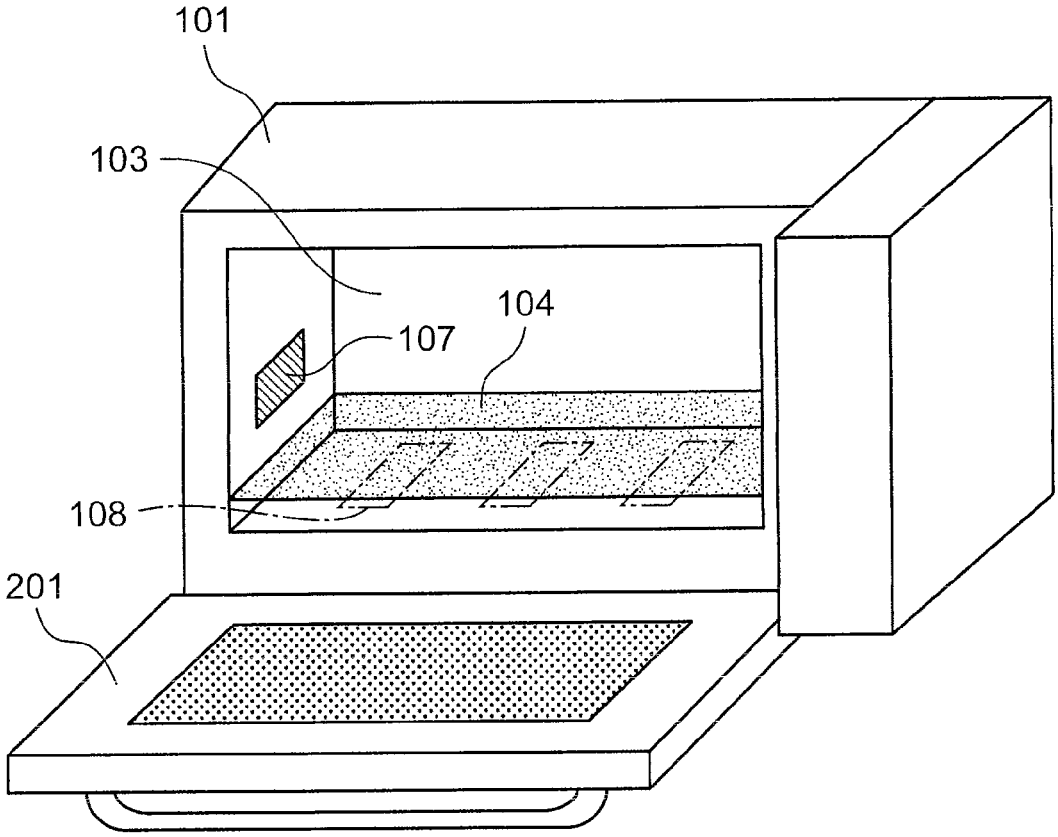
FIG. 2 is a perspective view of the microwave heating device according to the first embodiment of the present invention.

FIG. 2 is a perspective view of the microwave oven as the microwave heating device according to the first embodiment. Referring to FIG. 2, the microwave radiating portions 108 are constituted by the opening portions formed from the through openings which exist under the placement portion 104 and are formed in the surface shared between the waveguide tube 106 (not illustrated) and the heating chamber 103. Further, "201" designates a door which enables the object 102 to be heated to be taken in and out from the heating chamber 103. FIG. 2 illustrates the microwave heating device in a state where the door 201 is opened.

Figure 3:
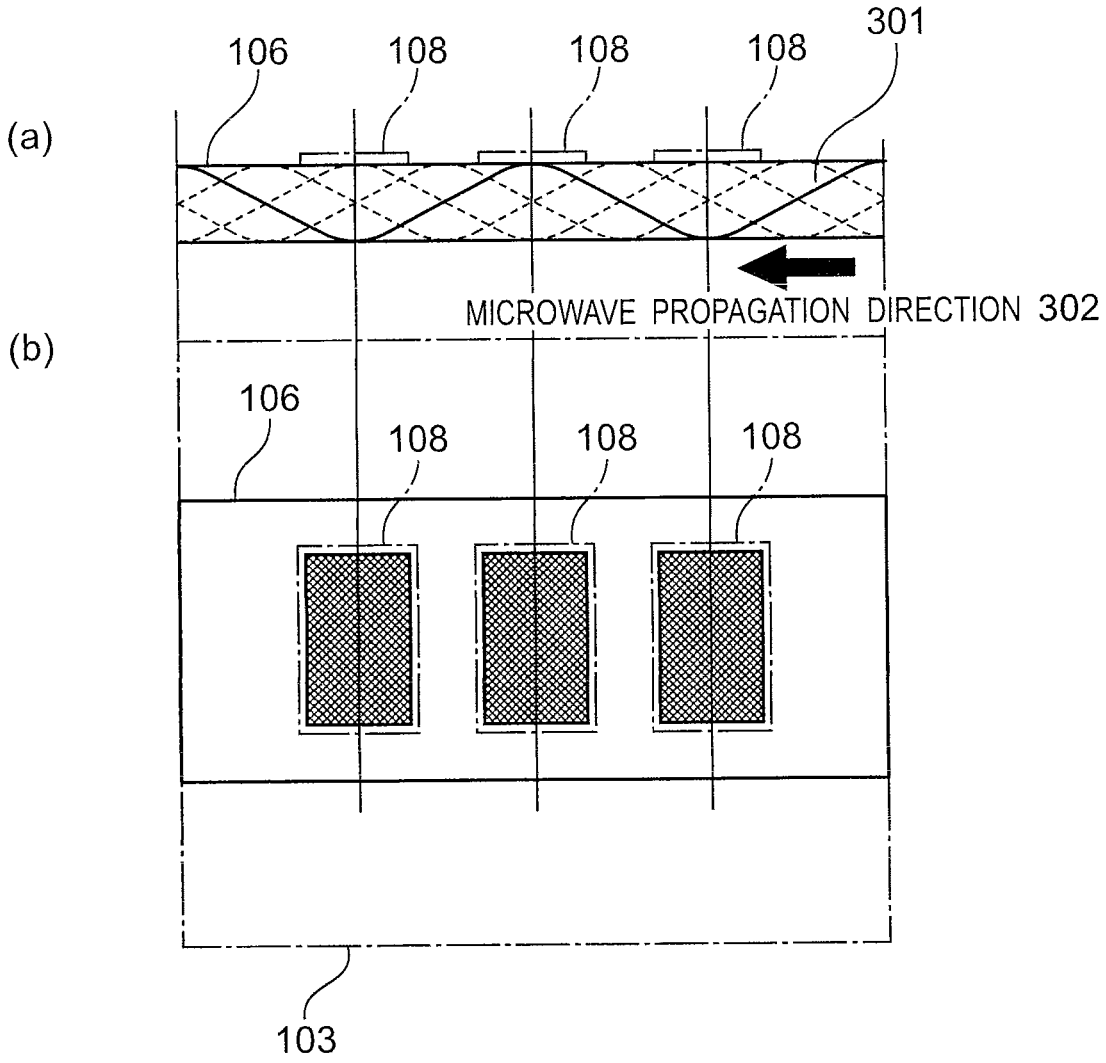
FIGS. 3(*a*) and (*b*) are views illustrating the relationship between microwave radiating portions, and a progressive wave propagating in the microwave propagation direction through a waveguide tube, in the microwave heating device according to the first embodiment of the present invention.

FIG. 3 is a view illustrating the relationship between the microwave radiating portions 108, and a progressive wave (microwave) propagating in the microwave propagation direction 302 through the waveguide tube 106, in the microwave heating device according to the first embodiment of the present invention. (a) of FIG. 3 is a side cross-sectional view of the waveguide tube 106, and (b) of FIG. 3 is a schematic view of the structure of the microwave radiating portions 108 formed on the upper surface of the waveguide tube 106 (the surface facing the heating chamber). In this case, the microwave radiating portions 108 will be described as being constituted by opening portions provided on the upper surface (the upper-side tube wall) of the waveguide tube 106 and as having the function of radiating microwaves existing in the waveguide tube 106, to the inside of the heating chamber 103.

Next, the microwave heating device having the aforementioned structure according to the first embodiment will be described, with respect to operations and effects of the device. At first, if a user places the object 102 to be heated on the placement portion 104 within the heating chamber 103 and, further, generates a command for start of heating, the magnetron as the microwave supply portion 105 is caused to supply microwaves to the inside of the waveguide tube 106, in the microwave heating device.

The microwave heating device according to the first embodiment is provided with the heating-chamber input portion 107 having the horn shape which extends toward the heating chamber 103 from the termination end of the waveguide tube 106 in the microwave propagation direction 302. Since the waveguide tube 106 is in the state of being connected at its termination end to the heating chamber 103 through the heating-chamber input portion 107, as described above, it is possible to realize a structure adapted such that most of the remaining microwaves having propagated through the waveguide tube 106 and reached the termination end of the waveguide tube 106 after having passed through the positions where the microwave radiating portions 108 are formed, without being radiated from the microwave radiating portions 108, are directed to the inside of the heating chamber 103 (a microwaves-ejecting structure). Accordingly, in the microwave heating device according to the first embodiment, microwaves propagating through the waveguide tube 106 are caused to form progressive waves 301 traveling in the microwave propagation direction 302, while being reflected in a smaller amount by the waveguide tube termination end.

In the microwave heating device according to the first embodiment, the opening shapes (the opening areas) of the respective microwave radiating portions 108 are adapted such that the amount of microwaves input to the heating chamber 103 through the heating-chamber input portion 7 is equal to or less than 10% of the total amount of microwaves radiated through the plurality of the microwave radiating portions 108. Since the opening shapes in the microwave radiating portions 108 are adapted as described above, in the microwave heating device according to the first embodiment, it is possible to secure a larger amount of microwaves from the microwave radiating portions 108, which are used for heating the object 102 to be heated, and, also, it is possible to realize a state where progressive waves 301 are dominant within the waveguide tube 106.

Accordingly, when progressive waves 301 propagate through the waveguide tube 106, as indicated by broken lines in (a) of FIG. 3, the progressive waves 301 travel through the waveguide tube 106, while changing their amplitudes at the positions where the microwave radiating portions 108 are formed (the positions of the formations).

As a result, while progressive waves 301 propagate through the waveguide tube 106, microwaves are radiated within the heating chamber 103 through the respective microwave radiating portions 108, thereby heating the object 102 to be heated. At this time, the microwaves propagating through the waveguide tube 106 are dispersed to the plurality of the opening portions which form the plurality of the microwave radiating portions 108, and microwaves are radiated to the inside of the heating chamber 103 through the respective opening portions, while the amounts of radiations of the microwaves are changed according to the amplitude changes in the progressive waves 301, which form the radiation source.

As described above, the microwave heating device according to the first embodiment is structured to direct microwaves through the heating-chamber input portion 107 to the heating chamber 103 from the termination end of the waveguide tube 106. Therefore, the microwave heating device according to the first embodiment is enabled to radiate microwaves to the inside of the heating chamber 103 through the microwave radiating portions 108 provided in the waveguide tube 106, thereby heating the object 102 to be heated, in the state where the microwaves propagating through the waveguide tube 106 form progressive waves 301 while forming less standing waves.

With the structure of the microwave heating device according to the first embodiment, progressive waves 301 being changed in amplitude are caused to pass through the positions where the microwave radiating portions 108 are formed and, therefore, microwaves are radiated through the opening portions which are dispersed at the plurality of positions, while the amounts of radiations of the microwaves are changed. As a result, with the structure according to the first embodiment, it is possible to provide a microwave heating device capable of performing uniform microwave heating on the object 102 to be heated, without employing a rotational mechanism.

Further, the microwave heating device according to the first embodiment has been described as having the microwave radiating portions 108 structured to have an opening shape as illustrated in FIG. 3, but the structure of the microwave radiating portions according to the present invention is not limited to such an opening shape and can be any structure capable of radiating microwaves to the inside of the heating chamber, such that progressive waves within the waveguide tube form a radiation source.

Further, the microwave heating device according to the first embodiment has been described with respect to an example where the heating-chamber input portion 107 is constituted by a horn-shaped structure, but, in the present invention, the shape of the heating-chamber input portion 107 can be any shape as long as the shape is capable of suppressing reflection of progressive waves within the waveguide tube and the portion is not limited to such a horn shape.

Second Embodiment

Hereinafter, a microwave heating device according to a second embodiment of the present invention will be described. The microwave heating device according to the second embodiment is different from the microwave heating device according to the aforementioned first embodiment, in that microwave radiating portions are structured to radiate circularly-polarized waves.

In the following description about the microwave heating device according to the second embodiment, components having the same functions and structures as those of the components of the microwave heating device according to the first embodiment will be designated by the same reference characters, and the description of the first embodiment will be applied to the detailed description of the second embodiment. Further, fundamental operations according to the second embodiment are similar to the operations according to the aforementioned first embodiment and, therefore, in the following description, different operations, effects and the like of the second embodiment from the operations according to the first embodiment will be described.

Figure 4:
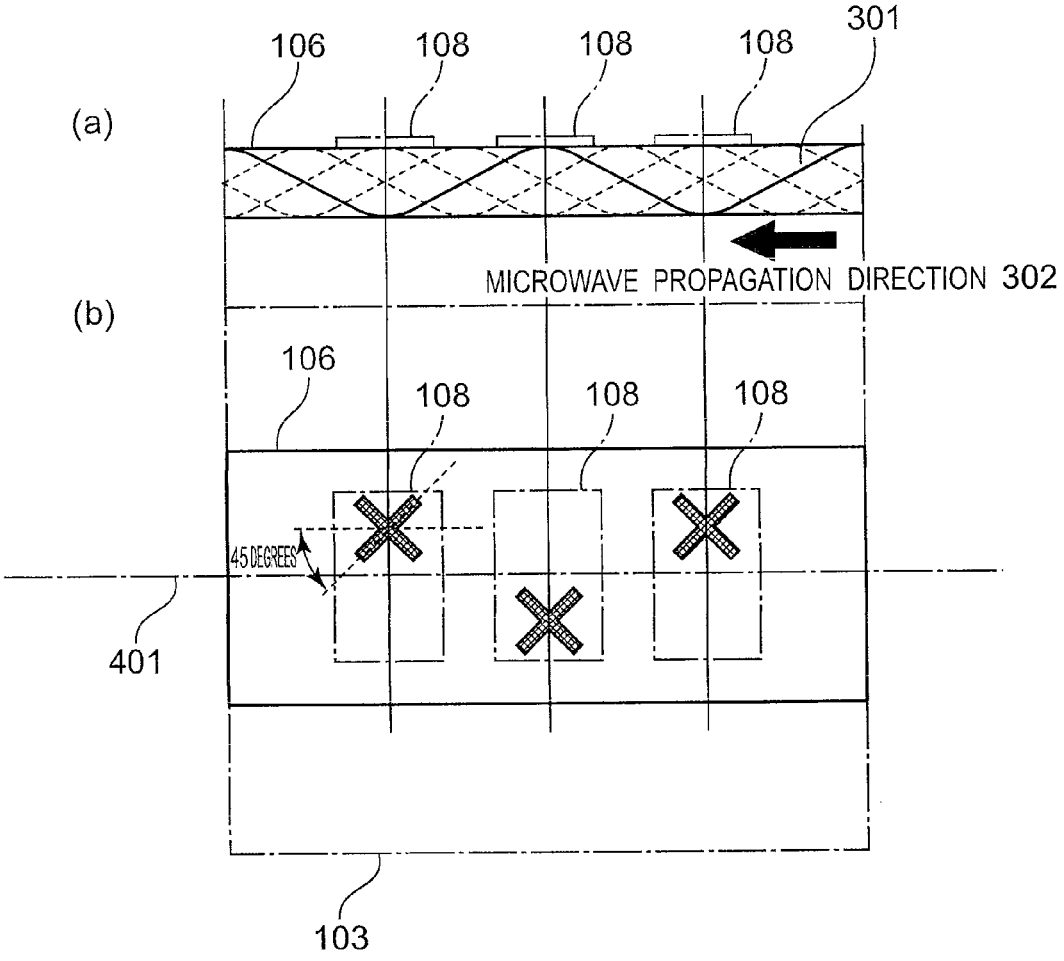
FIGS. 4(*a*) and (*b*) are views illustrating the relationship between microwave radiating portions and a progressive wave propagating in the microwave propagation direction through a waveguide tube, in a microwave heating device according to a second embodiment of the present invention.

FIG. 4 is a view illustrating the relationship between the microwave radiating portions 108, and a progressive wave (microwave) propagating in the microwave propagation direction 302 through a waveguide tube 106, in the microwave heating device according to the second embodiment of the present invention. (a) of FIG. 4 is a side cross-sectional view of the waveguide tube 106, and (b) of FIG. 4 is a plan view illustrating the structure of opening portions **108*a* in the microwave radiating portions 108 formed on the upper surface (the surface facing the heating chamber) of the waveguide tube 106. The opening portions 108*a* in the microwave radiating portions 108 are constituted by opening portions provided on the upper surface (the upper-side tube wall) of the waveguide tube 106 and, further, have the function of radiating microwaves existing in the waveguide tube 106, to the inside of the heating chamber 103**, in such a way that these microwaves form circularly-polarized waves.

In the microwave heating device according to the second embodiment, the opening portions **108*a* in the microwave radiating portions 108 are made to have an opening shape adapted to radiate circularly-polarized waves as illustrated in FIG. 4. Circular polarization is a technique which has been widely utilized in the fields of mobile communications and satellite communications, and examples of familiar usages of these communications include ETCs (Electronic Toll Collection Systems) "Non-Stop Automated Fee Collection Systems". A circularly-polarized wave is a microwave having an electric field with a polarization plane which is rotated, with time, with respect to the direction of radiowave propagation. When such a circularly-polarized wave is created, the direction of its electric field continuously changes with time. Therefore, microwaves being radiated within the heating chamber 103** exhibit the property of continuously changing in angle of radiation, while having a magnitude of an electric-field intensity being unchanged with time. Thus, in comparison with microwave heating using linearly-polarized waves, which have been used in conventional microwave heating device, it is possible to dispersedly radiate microwaves over a wider range, thereby enabling uniform microwave heating on objects to be heated. Particularly, there is a higher tendency of uniform heating in the circumferential direction of such circularly-polarized waves. Further, circularly-polarized waves are sorted into two types, which are right-handed polarized waves (CW: clockwise) and left-handed polarized waves (CCW: counter clockwise), based on their directions of rotations. However, there is no difference in heating performance between the two types.

The microwave heating device according to the second embodiment is adapted to radiate microwaves forming circularly-polarized waves, through the microwave radiating portions 108, using characteristics of circularly-polarized waves, thereby uniformizing the heating distribution within the heating chamber 103.

Further, in order to output circularly-polarized waves through the microwave radiating portions 108 provided in the rectangular-shaped waveguide tube 106, as illustrated in (b) of FIG. 4, the opening shape of the opening portions 108*a* in the microwave radiating portions 108 is made to be a shape formed by two slits in a straight-line shape having a width, which are intersected with each other at their respective centers and are inclined by 45 degrees with respect to the microwave propagation direction 302. Further, the opening portions 108*a* in the microwave radiating portions 108 are required to be placed at positions which are not intersected with the waveguide tube axis 401 of the waveguide tube 106 in the microwave propagation direction 302 (The waveguide tube axis 401 is the center axis of the waveguide tube 106 which is parallel with the microwave propagation direction 302).

As described above, in the second embodiment, the microwave radiating portions 108 are structured to radiate circularly-polarized waves, so that spreading microwaves are radiated within the heating chamber 103 through the microwave radiating portions 108, thereby uniformizing the radiation of microwaves over a wider range within the heating chamber 103.

Further, in the second embodiment, the microwave radiating portions 108 for radiating circularly-polarized waves have been described as in an opening shape illustrated in FIG. 4, but the opening shape according to the present invention is not limited to the shape illustrated in FIG. 4 and can be any shape capable of radiating circularly-polarized waves.

Third Embodiment

Hereinafter, a microwave heating device according to a third embodiment of the present invention will be described. The microwave heating device according to the third embodiment is different from the microwave heating device according to the aforementioned second embodiment, in terms of the structures of microwave radiating portions.

In the following description about the microwave heating device according to the third embodiment, components having the same functions and structures as those of the components of the microwave heating devices according to the first and second embodiments will be designated by the same reference characters, and the descriptions of the first and second embodiments will be applied to detailed description of the description of the third embodiment. Further, fundamental operations according to the third embodiment are similar to the operations according to the aforementioned first and second embodiments and, therefore, in the following description, different operations, effects and the like of the third embodiment from the operations according to the first and second embodiments will be described.

Figure 5:
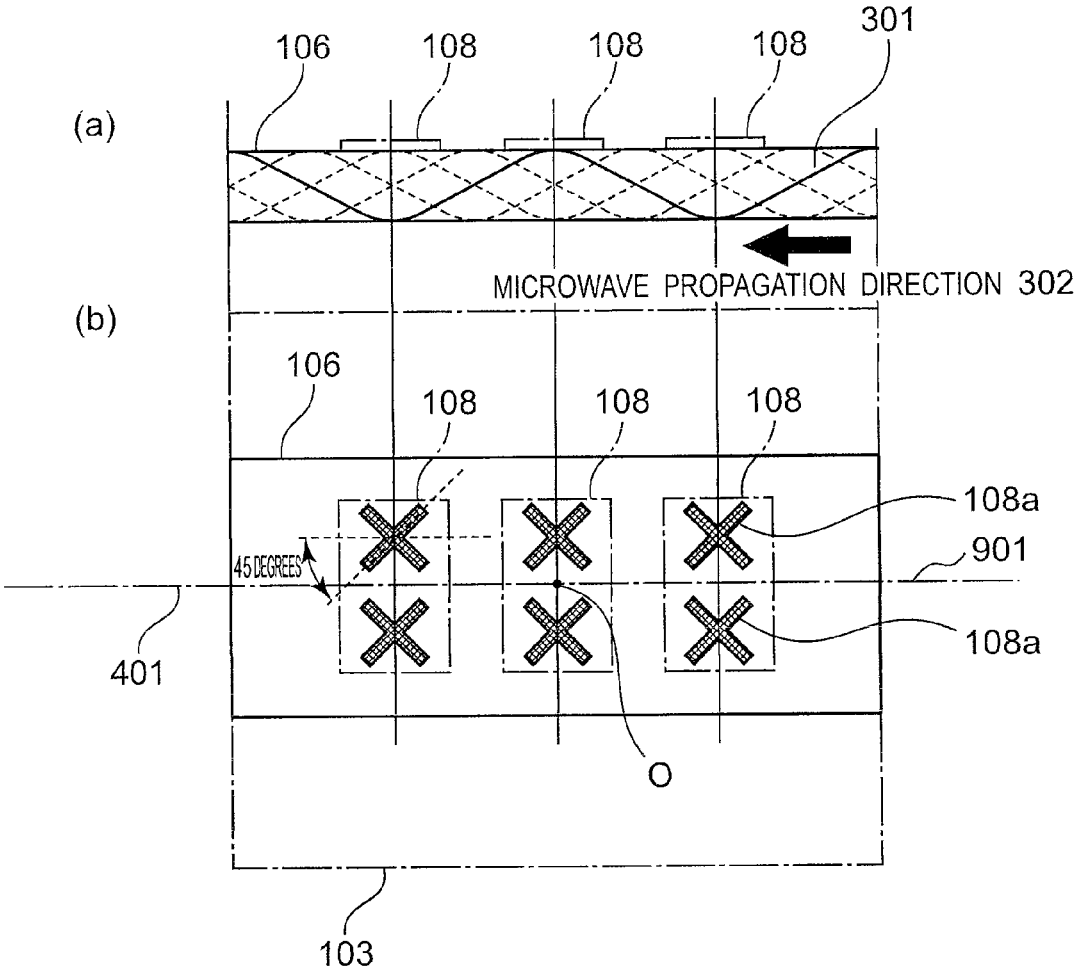
FIGS. 5(*a*) and (*b*) are views illustrating the relationship between microwave radiating portions and a progressive wave propagating in the microwave propagation direction through a waveguide tube, in a microwave heating device according to a third embodiment of the present invention.

FIG. 5 is a view illustrating the relationship between the microwave radiating portions 108, and a progressive wave (microwave) propagating in the microwave propagation direction 302 through a waveguide tube 106, in the microwave heating device according to the third embodiment of the present invention. (a) of FIG. 5 is a side cross-sectional view of the waveguide tube 106, and (b) of FIG. 5 is a plan view illustrating the structure of opening portions 108*a* in the microwave radiating portions 108 formed on the upper surface (the surface facing the heating chamber) of the waveguide tube 106. The opening portions 108*a* in the microwave radiating portions 108 are constituted by openings provided on the upper surface (the upper-side tube wall) of the waveguide tube 106 and, further, have the function of radiating microwaves existing in the waveguide tube 106, to the inside of the heating chamber 103, in such a way that these microwaves form circularly-polarized waves.

In the microwave heating device according to the third embodiment, the opening portions 108*a* in the microwave radiating portions 108 are structured to have a shape formed by two slits in a straight-line shape having a width, which are intersected with each other at their respective centers and are inclined by 45 degrees with respect to the microwave propagation direction 302, similarly to that in the structure according to the aforementioned second embodiment. Further, the opening portions 108*a* in the microwave radiating portions 108 are placed at positions which are not intersected with the waveguide tube axis 401 of the waveguide tube 106 in the microwave propagation direction 302. The waveguide tube 106, which is provided with the microwave radiating portions 108 having the aforementioned structure, is placed such that the waveguide tube axis 401 passes through the center O (see (b) of FIG. 5) of the bottom surface in the heating chamber 103 (its surface facing the microwave-radiating-portion formation surface of the waveguide tube 106), in the structure according to the third embodiment.

Accordingly, in the microwave heating device according to the third embodiment, the plurality of opening portions 108*a* in the plurality of microwave radiating portions 108 are placed at positions which are symmetric with respect to the center axis 901 of the heating chamber 103, as illustrated in (b) of FIG. 5. In this case, the center axis 901 of the heating chamber 103 passes through the center O of the bottom surface in the heating chamber 103 and is in the direction parallel with the microwave propagation direction 302 in the waveguide tube 106 (the direction toward the left and right side surfaces from the center O of the bottom surface in the heating chamber 103, in the third embodiment).

Since the plurality of the microwave radiating portions 108 are placed symmetrically with respect to the center axis 901 of the heating chamber 103, as described above, it is possible to perform microwave radiation symmetrically with respect to the object 102 to be heated, which is placed at the center of the heating chamber 103 in general. Also, it is possible to spread the microwave radiation in the forward and rearward directions in the heating chamber 103, which are directions normal to the waveguide tube axis 401 extending in the microwave propagation direction 302 in the waveguide tube 106. In this case, the forward and rearward directions in the heating chamber 103 are the upward and downward directions on the paper surface, in the heating chamber 103 illustrated in (b) of FIG. 5, and are the directions which connect the front-surface side, in which the door 201 is placed, to the rear-surface side opposed to the front-surface side.

Further, since the opening shape of the opening portions 108*a* in the microwave radiating portions 108 is made to be a shape capable of outputting circularly-polarized waves, it is possible to further enhance the effect of spreading by microwave heating, thereby enabling more uniform heating on the object 102 to be heated.

As described above, in the third embodiment, the plurality of the microwave radiating portions 108 for radiating circularly-polarized waves are placed symmetrically with respect to the center O of the heating chamber 103, which enables symmetric microwave heating on the object 102 to be heated and, further, enables spreading the microwave radiation in the forward and rearward directions in the heating chamber 103, which are normal to the waveguide tube axis 401 extending in the microwave propagation direction 302 in the waveguide tube 106. As a result, the microwave heating device according to the third embodiment is enabled to heat the object 102 to be heated more uniformly, through microwave radiation.

Fourth Embodiment

Hereinafter, a microwave heating device according to a fourth embodiment of the present invention will be described. The microwave heating device according to the fourth embodiment is different from the microwave heating device according to the aforementioned first embodiment, in terms of the structure and the placement of a heating-chamber input portion. Further, the microwave heating device according to the fourth embodiment will be described with respect to an example where the placement and the structure of the heating-chamber input portion is changed from those in the structure of the microwave heating device according to the first embodiment, and even if the placement and the structure of the heating-chamber input portion according to the fourth embodiment are applied to the structures according to the other embodiments described in the present specification, the same effects are exhibited.

In the following description about the microwave heating device according to the fourth embodiment, components having the same functions and structures as those of the components of the microwave heating devices according to the first to third embodiments will be designated by the same reference characters, and the descriptions of the first to third embodiments will be applied to the detailed description of the fourth embodiment. Further, fundamental operations according to the fourth embodiment are similar to the operations according to the aforementioned first to third embodiments and, therefore, in the following description, different operations, effects and the like of the fourth embodiment from the operations according to the first to third embodiments will be described.

Figure 6:
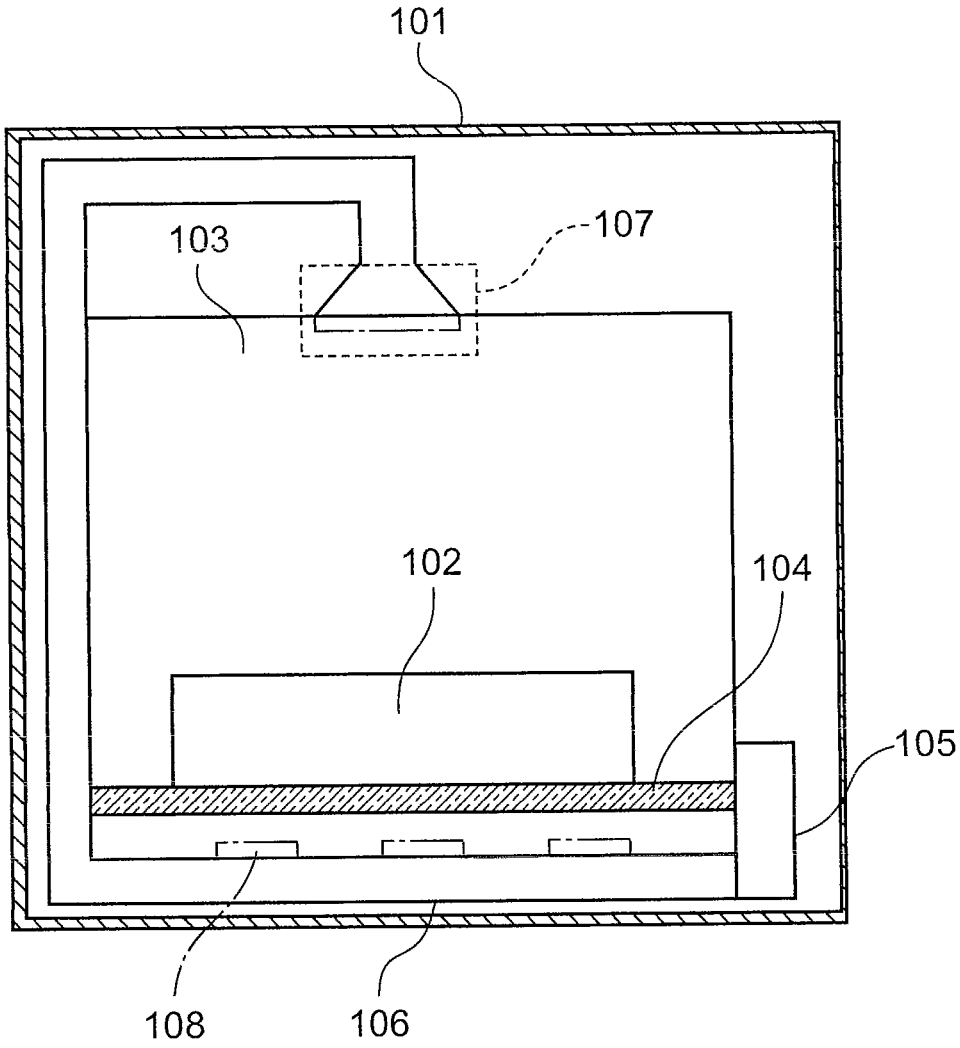
FIG. 6 is a schematic cross-sectional view of a microwave heating device according to a fourth embodiment of the present invention.

FIG. 6 is a cross-sectional view schematically illustrating the structure of a microwave oven as the microwave heating device according to the fourth embodiment of the present invention. As illustrated in FIG. 6, the structure of the microwave oven in the fourth embodiment is different from the microwave heating device according to the aforementioned first embodiment, in that the heating-chamber input portion 107 is placed in the surface facing the surface of the waveguide tube 106 which is provided with microwave radiating portions 108 (in the ceiling wall surface of the heating chamber 103).

As illustrated in FIG. 6, in the structure of the microwave heating device according to the fourth embodiment, the plurality of the microwave radiating portions 108 provided in the waveguide tube 106 are placed just beneath the bottom surface (the bottom surface wall) of the heating chamber 103. Further, the heating-chamber input portion 107, to which the waveguide tube 106 is connected at its termination end in the microwave propagation direction, is installed on the upper surface of the heating chamber 103, namely the ceiling wall surface of, which is the surface facing the microwave-radiating-portion formation surface of the waveguide tube 106 with the heating chamber 103 sandwiched between the two, so that progressive waves having reached the termination end of the waveguide tube 106 are directly directed to the inside of the heating chamber 103.

In this case, by forming the opening shapes (the opening areas) in the microwave radiating portions 108 such that the amount of microwaves input to the heating chamber 103 through the heating-chamber input portion 107 is about half the total amount of microwaves radiated through the plurality of the microwave radiating portions 108, it is possible to uniformly heat the object 102 to be heated from the bottom surface of the heating chamber 103 while heating the object 102 to be heated from above, since microwaves are input to the heating chamber through the heating-chamber input portion 107 placed at an upper portion (in the ceiling wall surface) of the heating chamber 103.

In this case, the microwave heating device according to the fourth embodiment is enabled to uniformize the heating distribution of the object 102 to be heated in the upward and downward directions.

As described above, in the structure according to the fourth embodiment, out of the wall surfaces forming the heating chamber 103, the wall surface in which the heating-chamber input portion 107 is placed, and the wall surface opposed to the microwave-radiating-portion formation surface of the waveguide tube 106, which is provided with the microwave radiating portions 108, are placed to form surfaces opposed to each other with the heating chamber 103 sandwiched between the two walls. Since the microwave radiating portions 108 and the heating-chamber input portion 107 are placed as described above, it is possible to uniformize the heating through the microwave radiating portions 108 from one wall surface of the heating chamber 103, while performing heating through the heating-chamber input portion 107 from the other wall surface of the heating chamber 103.

Also, in the microwave heating device according to the fourth embodiment, similarly to that in the structure according to the aforementioned first embodiment, the opening shapes (the opening areas) in the microwave radiating portions 108 can be formed such that the amount of microwaves input to the heating chamber 103 through the heating-chamber input portion 107 is equal to or less than 10% of the total amount of microwaves radiated through the plurality of the microwave radiating portions 108. With the microwave heating device having this structure, it is possible to increase the amount of microwaves radiated for the object 102 to be heated, from the microwave radiating portions 108, enabling fastening the heating and, further, making progressive waves dominant, among the microwaves within the waveguide tube 106. Accordingly, with the microwave heating device having this structure, it is possible to obtain the same effects as those of the first embodiment although the effects include no effect of uniformizing the heating distribution in the upward and downward directions, thereby enabling efficient and uniform heating of the object to be heated over a wider range.

Fifth Embodiment

Hereinafter, a microwave heating device according to a fifth embodiment of the present invention will be described. The microwave heating device according to the fifth embodiment is different from the microwave heating device according to the aforementioned first embodiment, in terms of the structure of a heating-chamber input portion. Further, the microwave heating device according to the fifth embodiment will be described with respect to an example where the placement and the structure of the heating-chamber input portion is changed from those in the structure of the microwave heating device according to the first embodiment, and even if the structure of the heating-chamber input portion according to the fifth embodiment can be also applied to the structures according to the other embodiments described in the present specification, the same effects is exhibited.

In the following description about the microwave heating device according to the fifth embodiment, components having the same functions and structures as those of the components of the microwave heating devices according to the first to third embodiments will be designated by the same reference characters, and the descriptions of the first to third embodiments will be applied to the detailed description of the fifth embodiment. Further, fundamental operations according to the fifth embodiment are similar to the operations according to the aforementioned first to third embodiments and, therefore, in the following description, different operations, effects and the like of the fifth embodiment from the operations according to the first to third embodiments will be described.

Figure 7:
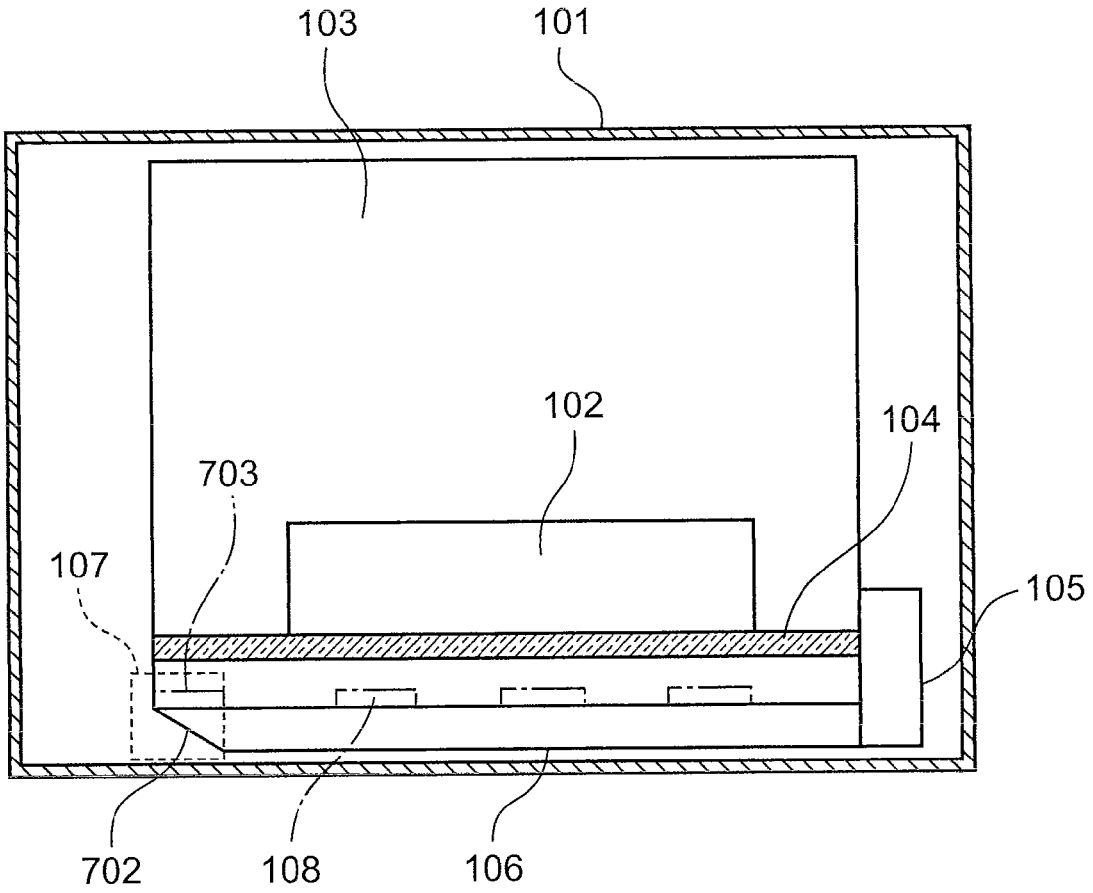
FIG. 7 is a schematic cross-sectional view of a microwave heating device according to a fifth embodiment of the present invention.

FIG. 7 is a cross-sectional view schematically illustrating the structure of the microwave heating device according to the fifth embodiment of the present invention. As illustrated in FIG. 7, the microwave heating device according to the fifth embodiment is different from the microwave heating device according to the aforementioned first embodiment, in that the heating-chamber input portion 107 is constituted by a reflective-surface structural portion 702 and an inputting opening portion 703, and the inputting opening portion 703 is formed in the same plane as that of a microwave-radiating-portion formation surface of a waveguide tube 106, which is provided with microwave radiating portions 108.

In the microwave heating device according to the fifth embodiment, the reflective-surface structural portion 702 is formed in the termination end of the waveguide tube 106 in the microwave propagation direction and, further, is constituted by a surface inclined with respect to the microwave propagation direction 302 in such a way as to chamfer this termination end. The reflective-surface structural portion 702 is adapted to reflect microwaves having propagated through the waveguide tube 106 and to direct them to the inside of the heating chamber 103 through the inputting opening portion 703 formed in the microwave-radiating-portion formation surface of the waveguide tube 106.

In the structure according to the fifth embodiment, microwaves supplied by a magnetron which forms a microwave supply portion 105 are propagated through the waveguide tube 106, and the remaining microwaves having reached the termination end of the waveguide tube 106 after passing through the positions where the microwave radiating portions 108 are formed, without being radiated through the microwave radiating portions 108, are reflected by the reflective-surface structural portion 702 which forms the heating-chamber input portion 107. The microwaves having been reflected by the reflective-surface structural portion 702 to be changed in direction in such a way as to be directed to the heating chamber 103 are directed to the inside of the heating chamber 103 through the inputting opening portion 703.

As described above, the microwave heating device according to the fifth embodiment is structured to direct, to the inside of the heating chamber 103, microwaves having propagated through the waveguide tube 106 and reached the termination end. As a result, the microwave heating device according to the fifth embodiment is enabled to make progressive waves dominant, among the microwaves within the waveguide tube 106.

Further, in the structure according to the first embodiment, by forming the opening shapes of the opening portions in the microwave radiating portions 108 such that the amount of microwaves input to the heating chamber 103 through the heating-chamber input portion 107 is equal to or less than 10% of the total amount of microwaves radiated through the plurality of the microwave radiating portions 108, it is possible to secure a larger amount of microwaves radiated through the microwave radiating portions 108, which are used for heating the object 102 to be heated, and, also, it is possible to realize a state where progressive waves 301 are dominant within the waveguide tube 106.

Further, in the structure according to the first embodiment, the heating-chamber input portion 107 for realizing the state where progressive waves are dominant among the microwaves propagating through the waveguide tube 106 can be placed in the same plane as that of the microwave-radiating-portion formation surface in the waveguide tube 106. This allows the microwave heating device according to the fifth embodiment to be compactly structured in its entirety.

As described above, the microwave heating device according to the fifth embodiment is structured such that the heating-chamber input portion 107 includes the reflective-surface structural portion 702 so that the heating-chamber input portion can compactly be formed, thereby finally attaining size reduction of the entire microwave heating device.

Sixth Embodiment

Hereinafter, a microwave heating device according to a sixth embodiment of the present invention will be described. The microwave heating device according to the sixth embodiment is different from the microwave heating device according to the aforementioned first embodiment, in terms of the structure of a heating-chamber input portion. Further, the microwave heating device according to the sixth embodiment will be described with respect to an example where the placement and the structure of the heating-chamber input portion is changed from those in the structure of the microwave heating device according to the first embodiment, and even if the structure of the heating-chamber input portion according to the sixth embodiment is also applied to the structures according to the other embodiments described in the present specification, the same effects can be exhibited.

In the following description about the microwave heating device according to the sixth embodiment, components having the same functions and structures as those of the components of the microwave heating devices according to the first to third embodiments will be designated by the same reference characters, and the descriptions of the first to third embodiments will be applied to the detailed description of the sixth embodiment. Further, fundamental operations according to the sixth embodiment are similar to the operations according to the aforementioned first to third embodiments and, therefore, in the following description, different operations, effects and the like of the sixth embodiment from the operations according to the first to third embodiments will be described.

Figure 8:
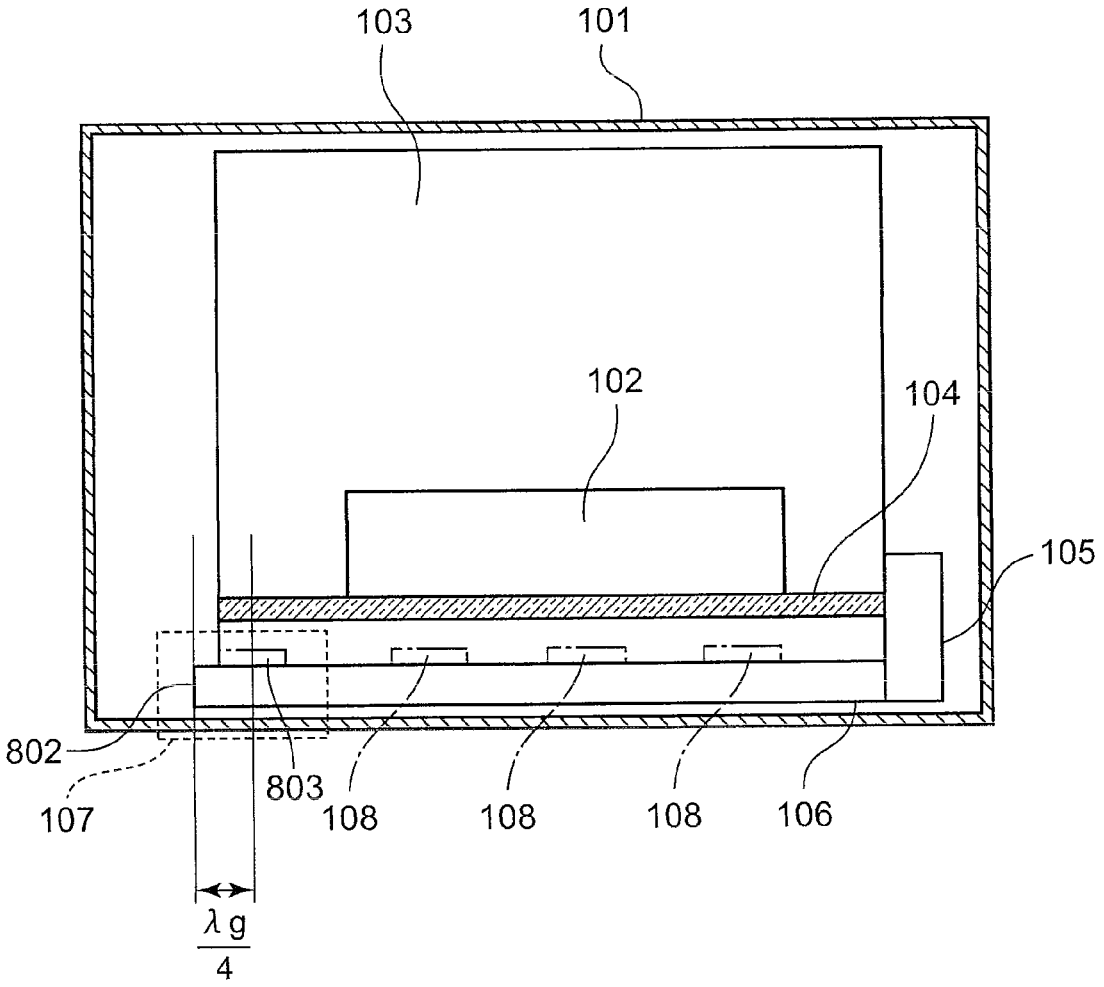
FIG. 8 is a schematic cross-sectional view of a microwave heating device according to a sixth embodiment of the present invention.

FIG. 8 is a cross-sectional view schematically illustrating the structure of the microwave heating device according to the sixth embodiment of the present invention. As illustrated in FIG. 8, the microwave heating device according to the sixth embodiment is different from the microwave heating device according to the aforementioned first embodiment, in that the heating-chamber input portion 107 is constituted by a termination-end closure portion 802 and a termination-end radiating portion 803, and the termination-end radiating portion 803 is formed in the same plane as that of a microwave-radiating-portion formation surface (the surface facing a heating chamber 103) of a waveguide tube 106, which is provided with microwave radiating portions 108. Further, in the microwave heating device according to the sixth embodiment, the distance in the microwave propagation direction from the termination-end closure portion 802 to the center of the termination-end radiating portion 803 in the waveguide tube 106 is set to have a length of an odd multiple of about ¼ the in-tube wavelength (λg) of microwaves supplied to the waveguide tube 106 from a microwave supply portion 105. The termination-end radiating portion 803 can be easily realized by using an opening portion formed similarly to the microwave radiating portions 108.

In the specification of the present application, the centers of the opening portions in the termination-end radiating portion 803 and the microwave radiating portions 108 refer to the positions of the centers of gravity in the plate members forming the respective opening shapes, assuming that these respective opening shapes are formed from the plate members having the same thickness. Further, the termination-end closure portion 802 in the waveguide tube 106 refers to the inner-wall surface in the closed portion of the waveguide tube 106 at the position of the termination end in the microwave propagation direction, while the starting-end portion is the position where the magnetron as the microwave supply portion 105 is caused to output microwaves, in the propagation space in the waveguide tube 106. Further, "about an odd multiple of ¼ the in-tube wavelength λg" is intended to cover "the range of from −10% to +10% of the numerical value of an odd multiple of ¼ the in-tube-wavelength λg.

Figure 9:
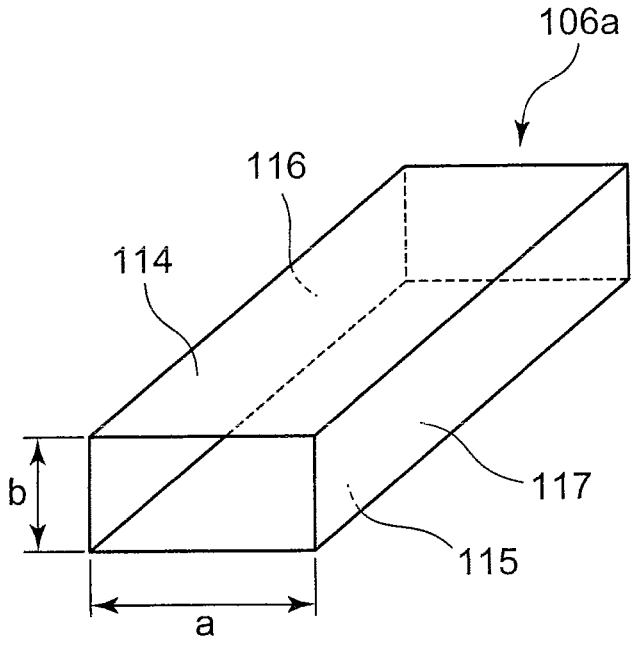
FIG. 9 is a view schematically illustrating the internal space in an ordinary waveguide tube having a rectangular parallelepiped shape.

Next, the in-tube wavelength (λg) in the waveguide tube will be described, with reference to FIG. 9. FIG. 9 is a view schematically illustrating the internal space in a simplest and ordinary rectangular waveguide tube 106*a* having a rectangular parallelepiped shape. The internal space in the simplest and ordinary rectangular waveguide tube 106*a* is constituted by a rectangular parallelepiped member adapted such that its cross section orthogonal to the direction of the tube axis has a rectangular shape (width "a"×height "b") and, also, its longitudinal direction is coincident with the direction of the tube axis, as illustrated in FIG. 9.

It has been known that this rectangular waveguide tube 106*a* propagates microwaves in the TE10 mode, in the case where the width "a" of the rectangular waveguide tube 106*a* is set to be shorter than a single wavelength (λ) of microwaves but longer than half the wavelength (λ/2), i.e., (λ>a>λ/2), and the height "b" of the rectangular waveguide tube 106*a* is set to be shorter than half the wavelength (λ/2), i.e., (b<λ/2), assuming that the wavelength output from the microwave supply portion 105 (the magnetron) is λ (λ=(the speed of light)/(the oscillation frequency)). In cases of microwave ovens, the wavelength λ is about 120 mm, the width "a" of such an ordinary rectangular waveguide tube 106*a* falls within the range of 80 mm to 100 mm, and its height "b" falls within the range of 15 mm to 40 mm.

In the rectangular waveguide tube 106*a* illustrated in FIG. 9, the upper and lower planes facing each other are referred to as H planes 114 and 115, which mean planes in which magnetic fields are eddied in parallel with each other, while the left and right planes facing each other are referred to as E planes 116 and 117, which mean planes parallel with the electric fields.

Further, the in-tube wavelength (the propagation wavelength) λg can be expressed as the following formula (1), assuming that the wavelength of microwaves being propagated through rectangular waveguide tube 106*a* is the in-tube wavelength, which is designated as λg, when microwaves (wavelength: λ) from the microwave supply portion 105 are supplied to the inside of the rectangular waveguide tube 106*a*.

[Formula 1]

$$\lambda g = \frac{\lambda}{\sqrt{1-\left(\frac{\lambda}{2a}\right)^2}} \tag{1}$$

As expressed by the formula (1), the in-tube wavelength (the propagation wavelength) λg is varied depending on the width "a" of the rectangular waveguide tube 106*a*, but does not relate to the height "b" of the rectangular waveguide tube 106*a*.

Figure 10:
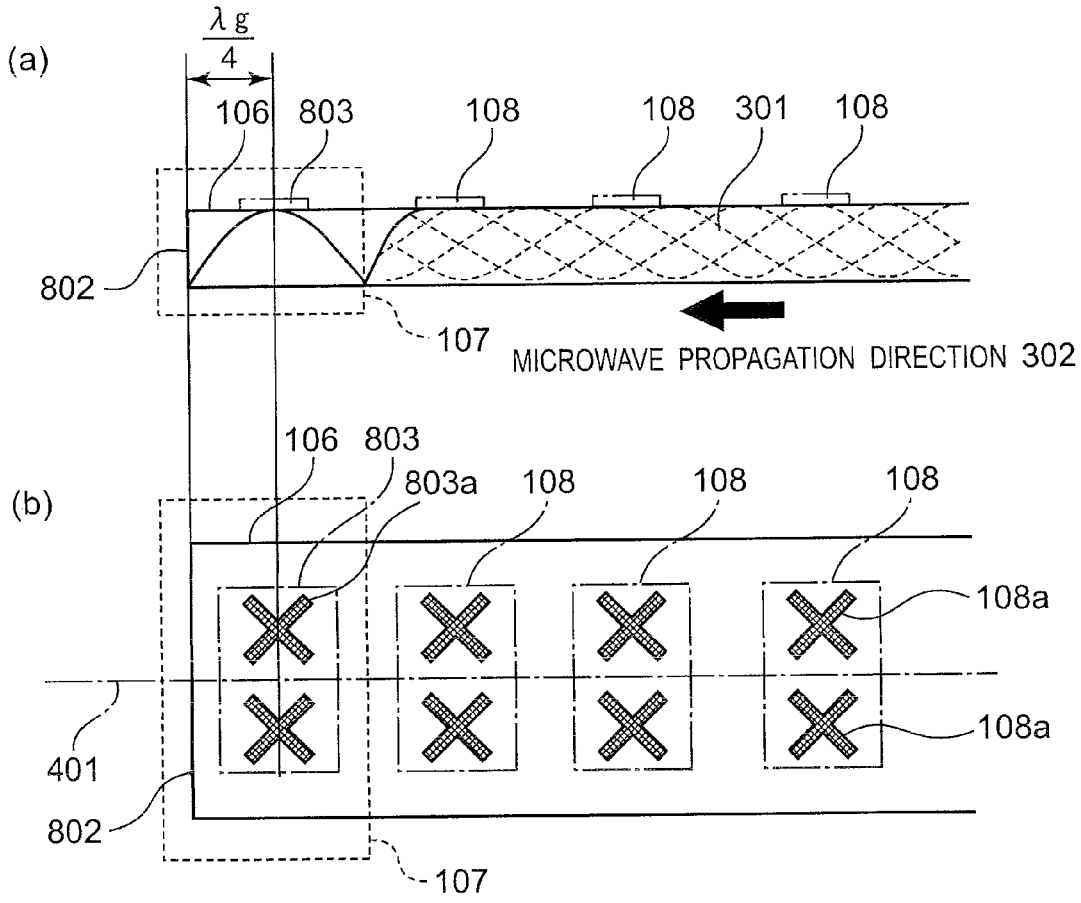
FIGS. 10(*a*) and (*b*) are views illustrating the relationship among microwave radiating portions, a heating-chamber input portion, and microwaves within a waveguide tube, in a microwave heating device according to a sixth embodiment of the present invention.

FIG. 10 is a view illustrating the relationship among the microwave radiating portions 108, the heating-chamber input portion 107, and microwaves within the waveguide tube 106, in the microwave heating device according to the sixth embodiment. (a) of FIG. 10 is a side cross-sectional view of the waveguide tube 106, and (b) of FIG. 10 is a view of the structures of the opening portions 108*a* in the microwave radiating portions 108 and the termination-end radiating portion 803 (the opening portions 803*a*) in the heating-chamber input portion 107, which are formed in the microwave-radiating-portion formation surface of the waveguide tube 106. The opening portions 108*a* in the microwave radiating portions 108 and the opening portions 803*a* in the termination-end radiating portion 803 are constituted by openings provided on the upper surface (the upper-side tube wall) in the waveguide tube 106 and, further, have the function of radiating microwaves existing in the waveguide tube 106, to the inside of the heating chamber 103, in such a way that these microwaves form circularly-polarized waves.

In the microwave heating device according to the sixth embodiment, the opening portions 108*a* in the microwave radiating portions 108 and the opening portions 803*a* in the termination-end radiating portion 803 are formed to have a shape formed by two slits in a straight-line shape having a width, which are intersected with each other at their respective centers and are inclined by 45 degrees with respect to the microwave propagation direction 302, similarly to that in the structure according to the aforementioned second embodiment. Further, the opening portions 108*a* in the microwave radiating portions 108 and the opening portions 803*a* in the termination-end radiating portion 803 are placed at positions which are not intersected with the waveguide tube axis 401 of the waveguide tube 106 in the microwave propagation direction 302.

As illustrated in (a) of FIG. 10, in the microwave heating device according to the sixth embodiment, microwaves supplied to the waveguide tube 106 from the microwave supply portion 105 are propagated through the waveguide tube 106 and are reflected by the termination-end closure portion 802 forming the heating-chamber input portion 107, thereby forming standing waves based on the in-tube wavelength λg around the termination-end closure portion 802. In this case, the termination-end radiating portion 803 is formed at the position of an anti-node (an odd multiple of (about ¼ the in-tube wavelength λg of microwaves within the waveguide tube 106)) in the standing waves at which the standing waves have a maximum amplitude.

In the microwave heating device according to the sixth embodiment, as illustrated in (b) of FIG. 10, the centers (the positions of the centers of gravity) of the opening portions 803*a* in the termination-end radiating portion 803 are placed at the position of an anti-node (an odd multiple of (about ¼ the in-tube wavelength λg of microwaves within the waveguide tube 106)) in the standing waves based on the in-tube wavelength λg so that microwaves at the position where they have the maximum amplitude can be radiated to the inside of the heating chamber 103, thereby realizing a structure for facilitating ejection of the remaining microwaves (a structure having the microwave-ejection function).

In the microwave heating device according to the sixth embodiment, since the heating-chamber input portion 107 is structured as described above, it is possible to realize a state where progressive waves 301 are dominant, within the waveguide tube 106, from the position where the microwave supply portion 105 supplies microwaves, to the microwave radiating portion 108 at the position where microwaves are radiated at the end to the inside of heating chamber 103.

Further, in the structure according to the sixth embodiment, the opening shapes (the opening areas) of the opening portions 108*a* in the microwave radiating portions 108 are adapted such that the amount of microwaves input to the heating chamber 103 through the heating-chamber input portion 107 is equal to or less than 10% of the total amount of microwaves radiated through the plurality of the microwave radiating portions 108. Since the opening shapes of the opening portions 108*a* in the microwave radiating portions 108 are adapted as described above, in the microwave heating device according to the sixth embodiment, it is possible to secure a larger amount of radiation of microwaves from the microwave radiating portions 108, which are used for heating the object 102 to be heated, and, also, it is possible to realize a state where progressive waves 301 are dominant within the waveguide tube 106.

Figure 11:
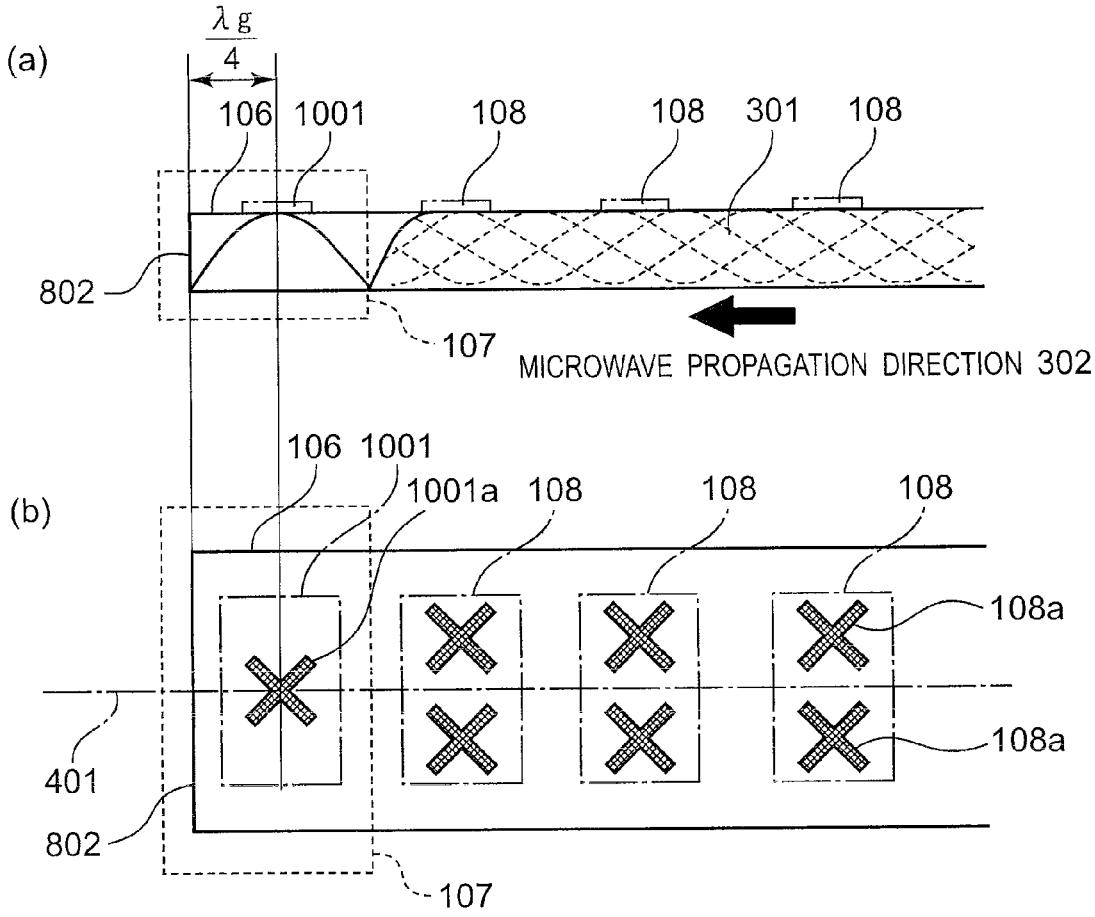
FIGS. 11(*a*) and (*b*) are views iew illustrating an example of modification of the heating-chamber input portion in the microwave heating device according to the sixth embodiment illustrated in FIG. 10 and is a relationship explanation view illustrating the placement of the microwave radiating portions in the microwave heating device according to the sixth embodiment of the present invention.

FIG. 11 is a view illustrating an example of modification of the heating-chamber input portion 107 illustrated in FIG. 10, wherein (a) of FIG. 11 is a side cross-sectional view of the waveguide tube 106, and (b) of FIG. 11 is a view of the structures of opening portions 108*a* in the microwave radiating portions 108 and an opening portion 1001*a* in a termination-end radiating portion 1001, which are formed on the microwave-radiating-portion formation surface of the waveguide tube 106. As illustrated in (b) of FIG. 11, the center (the position of the center of gravity) of the opening portion 1001*a* in the termination-end radiating portion 1001 is not only formed at the position of an anti-node in standing waves within the waveguide tube 106, which is a position where these standing waves have a maximum amplitude, but also placed on the waveguide tube axis (the center axis of the waveguide tube 106 which is parallel with the direction of propagation) 401, along which microwaves propagating in the TE10 mode through the waveguide tube 106 exhibit a highest intensity. This can realize a structure capable of ejecting microwaves forming standing waves, to the inside of the heating chamber 103, more easily, through the termination-end radiating portion 1001 in the heating-chamber input portion 107.

Figure 12:
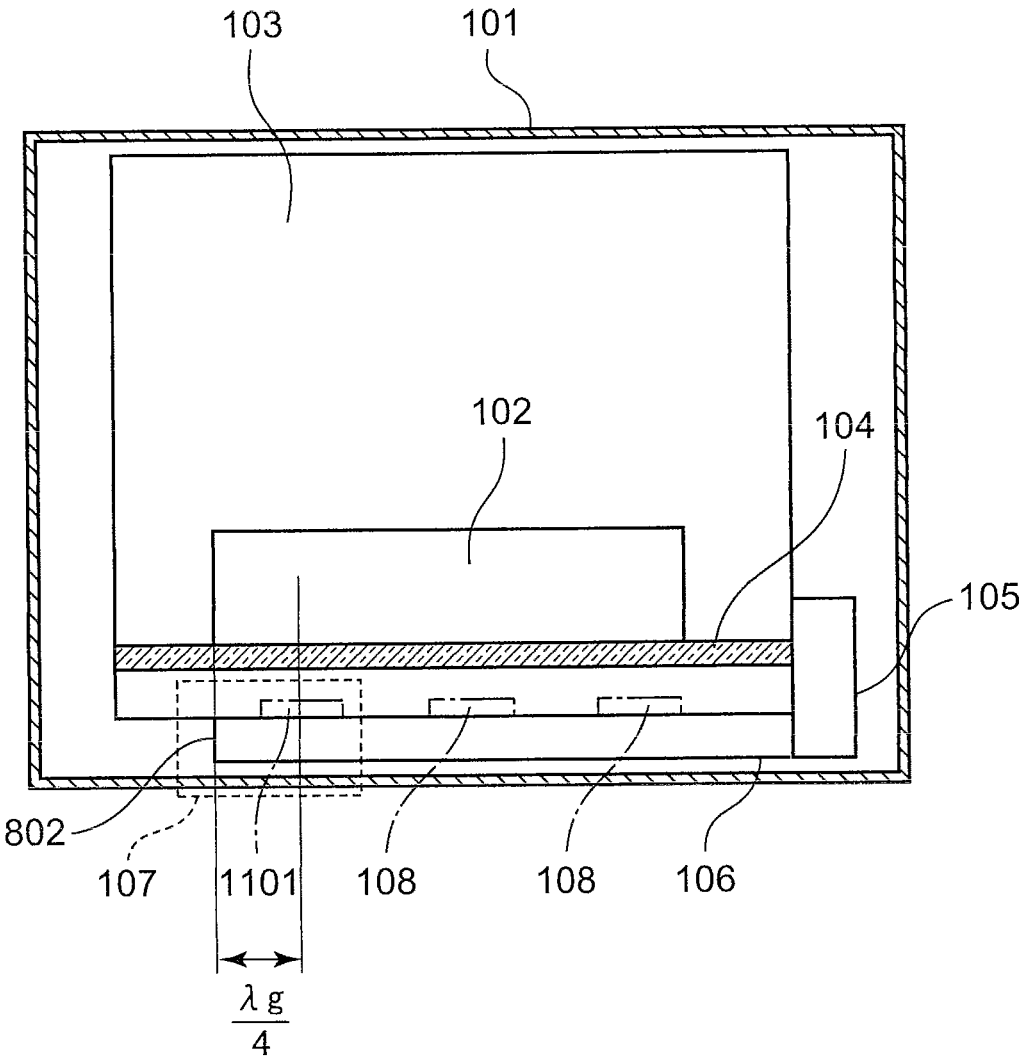
FIG. 12 is a schematic cross-sectional view illustrating an example of modification of the microwave heating device according to the sixth embodiment illustrated in FIG. 8.

FIG. 12 is a view illustrating an example of modification of the microwave heating device illustrated in FIG. 8 and, further, is a cross-sectional view illustrating an example where the placement of the waveguide tube 106 with respect to the heating area in the heating chamber 103 is changed. As illustrated in FIG. 12, a termination-end closure portion 802 in the waveguide tube 106 is placed just beneath the heating area in the heating chamber 103, and a termination-end radiating portion 1101 in a heating-chamber input portion 107 is provided at a position where it can direct microwaves to an object 102 to be heated. As a result, in the microwave heating device illustrated in FIG. 12, since the termination-end radiating portion 1101 is placed at the position where standing waves generated within the waveguide tube 106 have a maximum amplitude, the termination-end radiating portion 1101 is adapted to have the microwave ejecting function for ejecting the remaining microwaves to the inside of the heating chamber 103 and, also, to have the microwave radiating function for heating the object 102 to be heated. In the microwave heating device having this structure illustrated in FIG. 12, the heating-chamber input portion 107 can be compactly structured, without significantly degrading the uniformly-heating performance.

As described above, in the microwave heating device according to the sixth embodiment, the distance in the microwave propagation direction from the termination-end closure portion 802 forming the heating-chamber input portion 107 to the center (the position of the center of gravity) of the termination-end radiating portion 803, 1001, 1101 is made to have a length of an odd multiple of about ¼ the in-tube wavelength λg of standing waves generated in the waveguide tube 106. Due to the aforementioned structure, the microwave heating device according to the sixth embodiment is adapted to facilitate the ejection of the remaining microwaves to the inside of the heating chamber 103, since the termination-end radiating portion 803, 1001, 1101 is placed at the position where the standing waves have the maximum amplitude. This can enhance progressive wave components of microwaves propagating through the waveguide tube 106, thereby realizing a state where progressive waves are dominant, among microwaves propagating through the waveguide tube 106.

Further, since the termination-end radiating portion 1101 is placed at the position where standing waves generated in the waveguide tube 106 have the maximum amplitude, the termination-end radiating portion 1101 is made to have the microwave ejecting function for ejecting the remaining microwaves to the inside of the heating chamber 103 and, also, to have the microwave radiating function for heating the object 102 to be heated. This enables effective utilization of the bottom surface of the heating chamber 103 for uniformly heating the object 102 to be heated, without significantly degrading the uniformly-heating performance. This enables compactly forming the heating-chamber input portion 107.

Seventh Embodiment

Hereinafter, a microwave heating device according to a seventh embodiment of the present invention will be described. The microwave heating device according to the seventh embodiment is different from the microwave heating device according to the aforementioned first embodiment, in terms of the structure of a heating-chamber input portion. Further, the microwave heating device according to the seventh embodiment will be described with respect to an example where the placement and the structure of the heating-chamber input portion is changed from those in the structure of the microwave heating device according to the first embodiment, and even if the structure of the heating-chamber input portion according to the seventh embodiment can be also applied to the structures according to the other embodiments described in the present specification, the same effects can be exhibited.

In the following description about the microwave heating device according to the seventh embodiment, components having the same functions and structures as those of the components of the microwave heating devices according to the first to third embodiments will be designated by the same reference characters, and the descriptions of the first to third embodiments will be applied to the detailed description of the seventh embodiment. Further, fundamental operations according to the seventh embodiment are similar to the operations according to the aforementioned first to third embodiments and, therefore, in the following description, different operations, effects and the like of the seventh embodiment from the operations according to the first to third embodiments will be described.

Figure 13:
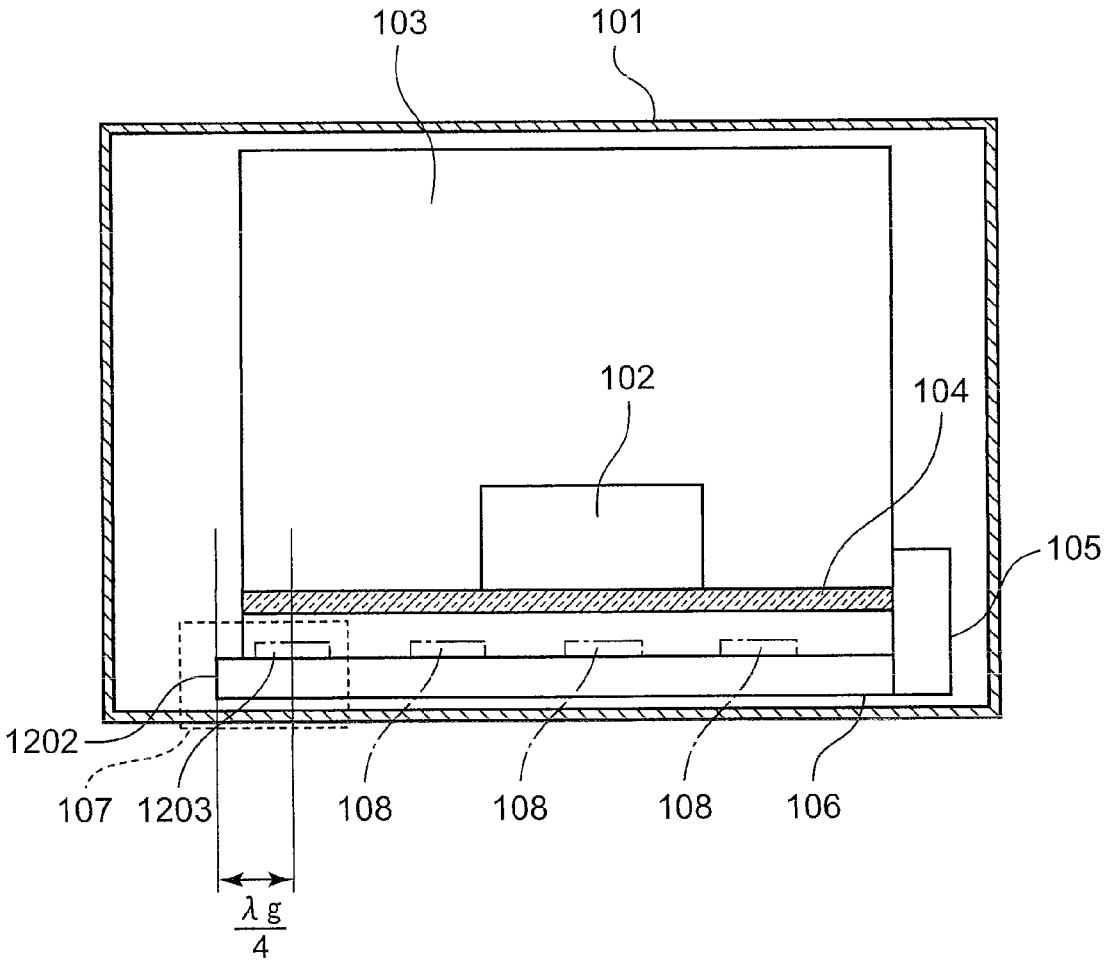
FIG. 13 is a schematic cross-sectional view illustrating the structure of a microwave heating device according to a seventh embodiment of the present invention.

FIG. 13 is a cross-sectional view schematically illustrating the structure of the microwave heating device according to the seventh embodiment of the present invention. As illustrated in FIG. 13, the microwave heating device according to the seventh embodiment is different from the microwave heating device according to the aforementioned first embodiment, in that a heating-chamber input portion 107 is constituted by a termination-end closure portion 1202 and a termination-end radiating portion 1203, and the termination-end radiating portion 1203 is formed in the same plane as that of a microwave-radiating-portion formation surface of a waveguide tube 106, which is provided with microwave radiating portions 108. Further, in the microwave heating device according to the seventh embodiment, the distance in the microwave propagation direction from the termination-end closure portion 1202 to the center (the position of the center of gravity) of the termination-end radiation portion 1203 in the waveguide tube 106 is set to be a length of an odd multiple of about ¼ the oscillation wavelength ($\lambda o$) of a microwave supply portion 105, which supplies microwaves to the waveguide tube 106. The termination-end radiating portion 1203 can be easily realized by using an opening portion formed similarly to the microwave radiating portions 108.

In cases where the object 102 to be heated forms a smaller load, for example, in cases where a single potato is heated, in the microwave heating device, the object 102 to be heated absorbs a smaller amount of microwaves and, therefore, a large amount of microwaves radiated through the microwave radiating portions 108 are returned to the inside of the waveguide tube 106 from the heating chamber 103 through the microwave radiating portions 108, without being absorbed by the object 102 to be heated.

Microwaves propagating through the waveguide tube 106 are apparently propagated while having the in-tube wavelength $\lambda g$, but microwaves as the radiation source are waves having the oscillation wavelength $\lambda o$ of the microwave supply portion 105. In cases of heating the object 102 to be heated, which forms a smaller load, a large amount of microwaves are returned to the inside of the waveguide tube 106 from the heating chamber 103 through the microwave radiating portions 108 as described above, and, as illustrated in (a) of FIG. 14, standing waves based on the oscillation wavelength $\lambda o$ of the microwave supply portion 105 are generated around the termination-end closure portion 1202 in the heating-chamber input portion 107.

Figure 14:
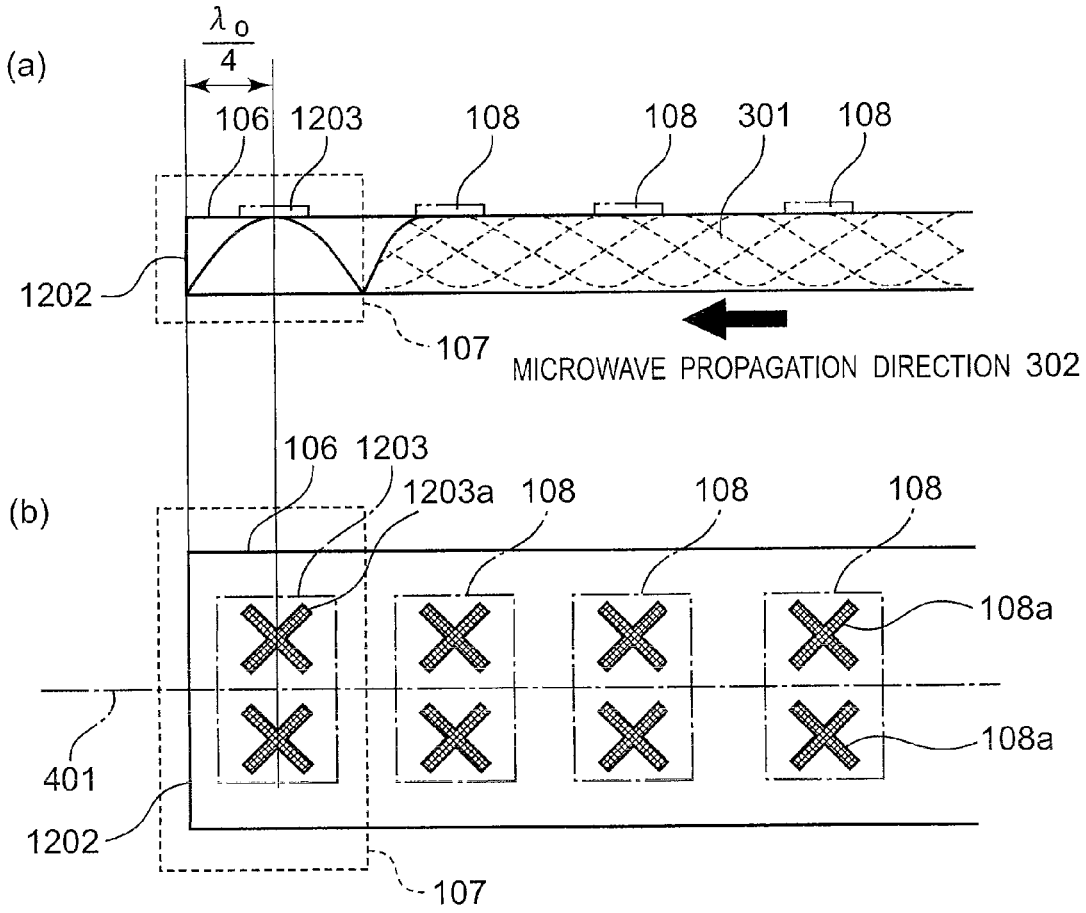
FIGS. 14(*a*) and (*b*) are views illustrating the relationship among microwave radiating portions, a heating-chamber input portion, and microwaves within a waveguide tube, in the microwave heating device according to the seventh embodiment of the present invention.

FIG. 14 is a view illustrating the relationship among the microwave radiating portions 108, the heating-chamber input portion 107, and microwaves within the waveguide tube 106, in the microwave heating device according to the seventh embodiment. (a) of FIG. 14 is a side cross-sectional view of the waveguide tube 106, and (b) of FIG. 14 is a view of the structures of the opening portions 108*a* in the microwave radiating portions 108 and the termination-end radiating portion 1203 (the opening portions 1203*a*) in the heating-chamber input portion 107, which are formed on the microwave-radiating-portion formation surface of the waveguide tube 106. The opening portions 108*a* in the microwave radiating portions 108 and the opening portions 1203*a* in the termination-end radiating portion 1203 are constituted by openings provided on the upper surface (the upper-side tube wall) in the waveguide tube 106 and, further, have the function of radiating microwaves existing in the waveguide tube 106, to the inside of the heating chamber 103, in such a way that these microwaves form circularly-polarized waves.

In the microwave heating device according to the seventh embodiment, the opening portions 108*a* in the microwave radiating portions 108 are formed to have a shape formed by two slits in a straight-line shape having a width, which are intersected with each other at their respective centers and are inclined by 45 degrees with respect to the microwave propagation direction 302, similarly to that in the structure according to the aforementioned second embodiment. Further, the opening portions 108*a* in the microwave radiating portions 108 and the opening portions 1203*a* in the termination-end radiating portion 1203 are placed at positions which are not intersected with the waveguide tube axis 401 of the waveguide tube 106 in the microwave propagation direction 302.

The microwave heating device according to the seventh embodiment is adapted to place importance on the performance for heating an object 102 to be heated, which forms a smaller load. In such cases of placing importance on the performance for heating an object 102 to be heated, which forms a smaller load, as illustrated in (b) of FIG. 14, the centers (the positions of the centers of gravity) of the opening portions 1203*a* in the termination-end radiating portion 1203 are placed at the position of an anti-node (an odd multiple of (about ¼ the oscillation wavelength of microwaves supplied from the microwave supply portion 105)) in standing waves based on the oscillation wavelength $\lambda o$ of the microwave supply portion 105 which supplies microwaves to the waveguide tube 106, so that the opening portions 1203*a* for directing microwaves to the heating chamber 103 are placed at the position where the standing waves have the maximum amplitude. Accordingly, the microwave heating device according to the seventh embodiment is adapted to have a structure for facilitating the ejection of microwaves to the inside of the heating chamber 103 through the opening portions 1203*a* in the termination-end radiating portion 1203, at the position of the anti-node in the standing waves based on the wavelength $\lambda o$ of microwaves supplied from the microwave supply portion 105, which is created around the termination-end closure portion 1202 in the waveguide tube 106 (a structure having the microwave ejecting function).

In the microwave heating device according to the seventh embodiment, since the heating-chamber input portion 107 is structured as described above, it is possible to realize a state where progressive waves 301 are dominant, within the waveguide tube 106, from the position where the microwave supply portion 105 supplies microwaves, to the microwave radiating portion 108 at the position where microwaves are radiated at the end to the inside of heating chamber 103.

Further, in the structure according to the seventh embodiment, the opening shapes (the opening areas) of the opening portions 108*a* in the microwave radiating portions 108 are adapted such that the amount of microwaves input to the heating chamber 103 through the heating-chamber input portion 7 is equal to or less than 10% of the total amount of microwaves radiated through the plurality of the microwave radiating portions 108. Since the opening shapes of the opening portions 108*a* in the microwave radiating portions 108 are adapted as described above, in the microwave heating device according to the seventh embodiment, it is possible to secure a large amount of radiation of microwaves from the microwave radiating portions 108, which are used for heating the object 102 to be heated, and, also, it is possible to realize a state where progressive waves 301 are dominant within the waveguide tube 106.

Figure 15:
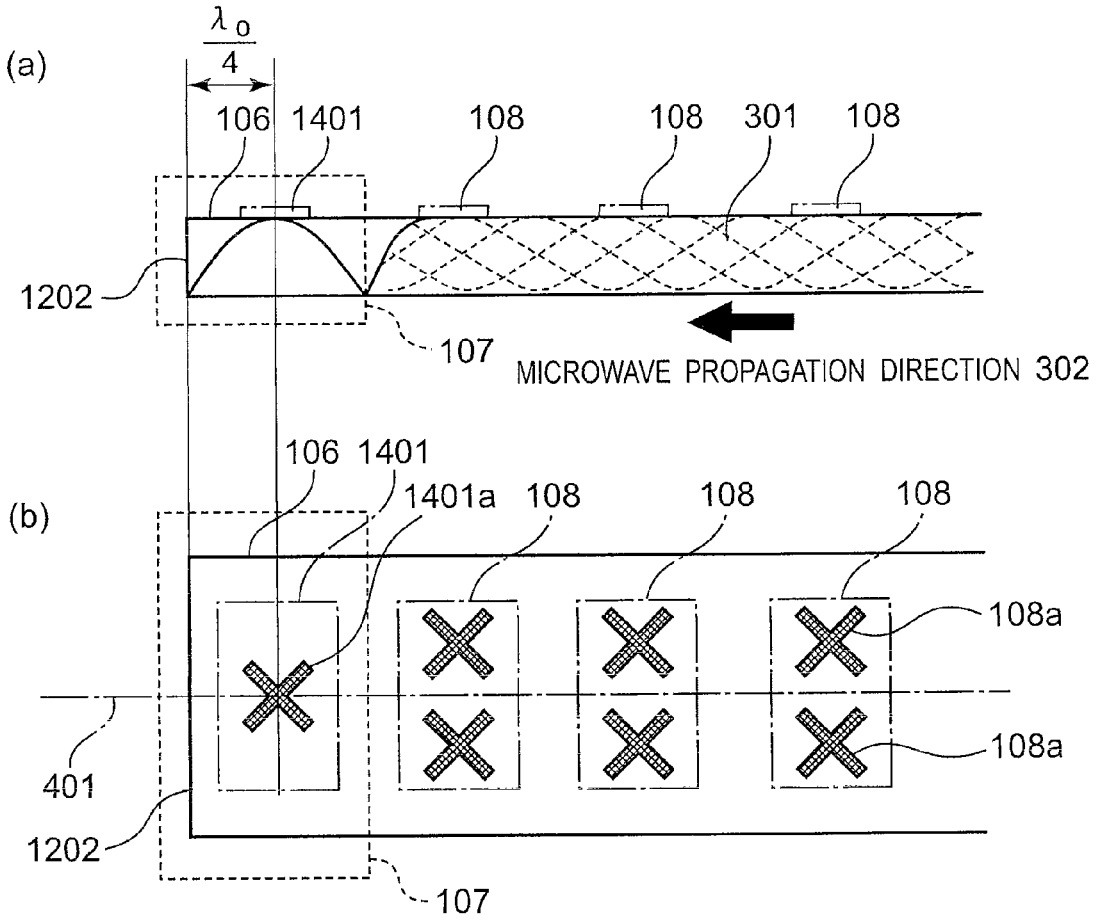
FIGS. 15(*a*) and (*b*) are views illustrating an example of modification of the heating-chamber input portion in the microwave heating device according to the seventh embodiment illustrated in FIG. 14.

FIG. 15 is a view illustrating an example of modification of the heating-chamber input portion 107 illustrated in FIG. 14, wherein (a) of FIG. 15 is a side cross-sectional view of the waveguide tube 106, and (b) of FIG. 15 is a view of the structures of the opening portions 108*a* in the microwave radiating portions 108 and an opening portion 1401*a* in a termination-end radiating portion 1401, which are formed on the microwave-radiating-portion formation surface of the waveguide tube 106. As illustrated in (b) of FIG. 15, the center (the position of the center of gravity) of the opening portion 1401*a* in the termination-end radiating portion 1401 is not only formed at the position of an anti-node in standing waves within the waveguide tube 106, which is a position where these standing waves have a maximum amplitude, but also placed on the waveguide tube axis (the center axis of the waveguide tube 106 which is parallel with the direction of propagation) 401, along which microwaves propagating in the TE10 mode through the waveguide tube 106 exhibit a highest intensity. This can realize a structure capable of ejecting microwaves forming standing waves, to the inside of the heating chamber 103, more easily, through the termination-end radiating portion 1401 in the heating-chamber input portion 107.

Figure 16:
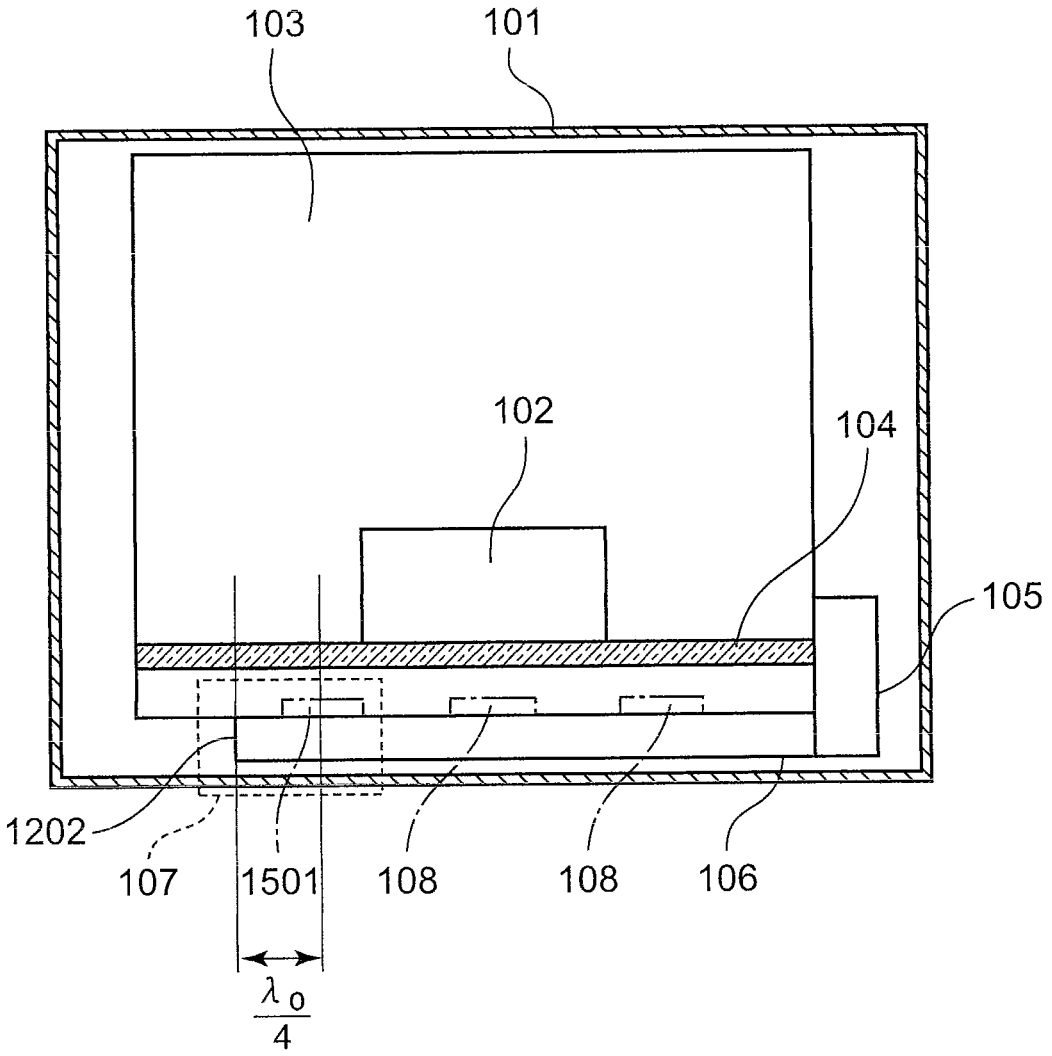
FIG. 16 is a schematic cross-sectional view illustrating an example of modification of the microwave heating device according to the seventh embodiment illustrated in FIG. 13.

FIG. 16 is a view illustrating an example of modification of the microwave heating device illustrated in FIG. 13 and, further, is a cross-sectional view illustrating an example where the placement of the waveguide tube 106 with respect to the heating area in the heating chamber 103 is changed. As illustrated in FIG. 16, a termination-end closure portion 1202 in the waveguide tube 106 is placed just beneath the heating area in the heating chamber 103, and a termination-end radiating portion 1501 in a heating-chamber input portion 107 is provided at a position where it can direct microwaves to an object 102 to be heated. As a result, in the microwave heating device illustrated in FIG. 16, since the termination-end radiating portion 1501 is placed at the position where the standing waves generated within the waveguide tube 106 have a maximum amplitude, the termination-end radiating portion 1501 is adapted to have a microwave ejecting function for ejecting the remaining microwaves to the inside of the heating chamber 103 and, also, to have a microwave radiating function for heating the object 102 to be heated. In the microwave heating device having this structure illustrated in FIG. 16, the heating-chamber input portion 107 can be compactly structured, without significantly degrading the uniformly-heating performance.

As described above, the structure of the microwave heating device according to the seventh embodiment is an effective structure in cases where the object 102 to be heated forms a smaller load. In cases where the object 102 to be heated forms a smaller load, the object 102 to be heated absorbs a smaller amount of microwaves and, therefore, microwaves having been once radiated to the heating chamber 103 through the microwave radiating portions 108 are returned to the waveguide tube 106 from the heating chamber 103 through the microwave radiating portions 108. In this case, the wavelength of such microwaves returned thereto is the oscillation wavelength λo of the microwave supply portion 105. In the microwave heating device according to the seventh embodiment, the distance in the microwave propagation direction from the termination-end closure portion 1202 forming the heating-chamber input portion 107 to the center (the position of the center of gravity) of the termination-end radiating portion 1203, 1401, 1501 is made to have a length of an odd multiple of about ¼ the wavelength of microwaves returned from the heating chamber 103 (the oscillation wavelength λo of the microwave supply portion 105). Due to this structure, the microwave heating device according to the seventh embodiment is adapted to facilitate the ejection of the remaining microwaves to the inside of the heating chamber 103 since the termination-end radiating portion 1203, 1401, 1501 is placed at the position where the standing waves have the maximum amplitude. This can enhance progressive wave components of microwaves propagating through the waveguide tube 106, thereby realizing a state where progressive waves are dominant, among microwaves propagating through the waveguide tube 106.

Further, since the termination-end radiating portion 1501 is placed at the position where the standing waves generated in the waveguide tube 106 have the maximum amplitude, the termination-end radiating portion 1501 is adapted to have a microwave ejecting function for ejecting microwaves to the inside of the heating chamber 103 and, also, to have a microwave radiating function for heating the object 102 to be heated. This enables effective utilization of the bottom surface of the heating chamber 103 for uniformly heating the object 102 to be heated, without significantly degrading the uniformly-heating performance. This enables compactly forming the heating-chamber input portion 107.

The microwave heating device according to the present invention is adapted such that microwaves having propagated through the waveguide tube and having passed through the positions where the microwave radiating portions are formed are directed to the inside of the heating chamber, through the heating-chamber input portion, thereby realizing a state where progressive waves are dominant while there are less standing waves, among microwaves propagating through the waveguide tube. Since there is realized the state where progressive waves are dominant in the waveguide tube, such progressive waves being changed in amplitude are caused to pass through the microwave radiating portions, which enables radiating microwaves to the inside of the heating chamber through the opening portions of the microwave radiating portions dispersed at a plurality of positions, while changing the amounts of radiations of the microwaves, thereby enabling uniform heating of the object to be heated. Accordingly, with the present invention, it is possible to provide a microwave heating device capable of performing uniform microwave heating on the object to be heated, without using a rotational mechanism.

In the microwave heating device according to the present invention, the plurality of the microwave radiating portions are placed symmetrically with respect to the center of the heating chamber, thereby enabling symmetric and uniform radiation of microwaves for the object to be heated, which is placed at the center of the inside of the heating chamber.

Further, the microwave heating device according to the present invention is adapted such that the amount of microwaves input to the heating chamber through the heating-chamber input portion is equal to or less than 10% of the total amount of microwaves radiated through the plurality of the microwave radiating portions, which enables securing a larger amount of microwaves for use for heating the object to be heated and, also, realizing a state where progressive waves are dominant within the waveguide tube.

In the microwave heating device according to the present invention, on the surfaces forming the heating chamber, the surface in which the heating-chamber input portion is placed, and the surface in which the microwave radiating portions are placed are adapted to form surfaces opposed to each other, which enables uniformizing the heating of the object to be heated through the microwave radiating portions, while performing heating through the heating-chamber input portion.

In the microwave heating device according to the present invention, the heating-chamber input portion can be structured to include a reflective-surface structural portion, which enables compactly forming the heating-chamber input portion.

In the microwave heating device according to the present invention, the microwave radiating portions can be structured to radiate circularly-polarized waves, which enables uniform heating over a wider range, within the heating area.

In the microwave heating device according to the present invention, the heating-chamber input portion is structured to include the termination-end closure portion and the termination-end radiating portion, and the distance in the microwave propagation direction from the termination-end closure portion to the center (the position of the center of gravity) of the termination-end radiating portion is set to be a length of an odd multiple of (about ¼ the in-tube wavelength in the waveguide tube). In the microwave heating device having this structure according to the present invention, the position of the center (the position of the center of gravity) of the termination-end radiating portion is coincident with the position of an anti-node in standing waves based on the in-tube wavelength, which can facilitate the ejection of microwaves from the termination-end radiating portion, thereby making progressive waves dominant, among microwaves propagating through the waveguide tube.

The microwave heating device according to the present invention is capable of forming an effective structure, in cases of placing importance on the performance for heating a smaller load, where the microwave heating device exhibits the property of causing microwaves having been once radiated through the microwave radiating portions to return to the inside of the waveguide tube from the heating chamber through the microwave radiating portions, while having the oscillation wavelength of the microwave supply portion, since the object to be heated absorbs a smaller amount of microwaves. Namely, in the microwave heating device according to the present invention, the heating-chamber input portion is structured to include the termination-end closure portion and the termination-end radiating portion, and the distance in the microwave propagation direction from the termination-end closure portion to the center (the position of the center of gravity) of the termination-end radiating portion is made to have a length of an odd multiple of (about ¼ the oscillation wavelength of the microwave supply portion). In the microwave heating device having this structure according to the present invention, in cases of placing importance on the performance for heating a smaller load, an anti-node in standing waves based on the oscillation wavelength of the microwave supply portion can be placed at the center (the position of the center of gravity) of the termination-end radiating portion, which can facilitate the ejection of microwaves from the termination-end radiating portion, thereby causing microwaves propagating through the waveguide tube to form progressive waves.

Further, in the microwave heating device according to the present invention, the termination-end radiating portion is structured to have the microwave ejecting function for ejecting, to the inside of the heating chamber 103, microwaves based on the standing waves induced within the waveguide tube and, also, to have the microwave radiating function for heating the object to be heated. This enables compactly forming the heating-chamber input portion.

The microwave heating device according to the present invention is adapted such that the remaining microwaves having propagated through the waveguide tube while having passed through the positions where the microwave radiating portions are formed, without being radiated through the microwave radiating portions, are directed to the inside of the heating chamber, through the heating-chamber input portion. As a result, the microwave heating device according to the present invention is adapted to realize a state where progressive waves are dominant while there are less standing waves within the waveguide tube, which enables efficiently heating the object to be heated, by radiating microwaves to the inside of the heating chamber through the microwave radiating portions provided in the waveguide tube. With the structure of the microwave heating device according to the present invention, progressive waves being changed in amplitude are caused to pass through the positions where the microwave radiating portions are formed within the waveguide tube, so that microwaves are dispersed and radiated through the opening portions dispersed at the plurality of positions while the amounts of radiations of the microwaves are varied. This enables uniform microwave heating of the object to be heated, without using a rotational mechanism.

INDUSTRIAL APPLICABILITY

The microwave heating device according to the present invention is capable of uniformly radiating microwaves for the object to be heated and, therefore, the microwave heating device can be effectively utilized as microwave heating devices for performing heating processing and disinfection of foods.

The invention claimed is:

1. A microwave heating device comprising:

a heating chamber adapted to house an object to be heated;

a microwave supply portion for supplying microwaves to the heating chamber;

a waveguide tube for propagating microwaves supplied from the microwave supply portion, to the heating chamber;

a plurality of microwave radiating portions which are formed on the waveguide tube and are for radiating microwaves propagating through the waveguide tube, to inside of the heating chamber; and a heating-chamber input portion which is adapted to direct, to the inside of the heating chamber, microwaves having propagated through the waveguide tube and having passed through positions where the microwave radiating portions are formed, to realize a state where a progressive wave is dominant, among the microwaves propagating through the waveguide tube;

wherein the microwave radiating portions are adapted to radiate, to the inside of the heating chamber, microwaves based on the progressive wave propagating through the waveguide tube.

2. The microwave heating device according to claim 1, wherein the plurality of the microwave radiating portions are placed symmetrically with respect to a center of the heating chamber.

3. The microwave heating device according to claim 1, which is adapted such that an amount of microwaves input to the inside of the heating chamber through the heating-chamber input portion is equal to or less than 10% of a total amount of microwaves radiated to the inside of the heating chamber through the plurality of the microwave radiating portions.

4. The microwave heating device according to claim 1, wherein surfaces forming the heating chamber are adapted such that a surface in which the heating-chamber input portion is placed, and a surface in which the microwave radiating portions are placed, are facing each other.

5. The microwave heating device according to claim 1, wherein the heating-chamber input portion comprises a reflective-surface structural portion formed in a termination end of the waveguide tube in a microwave propagation direction, and an inputting opening portion adapted to direct, to the inside of the heating chamber, microwaves having been reflected by the reflective-surface structural portion.

6. The microwave heating device according to claim 1, wherein the microwave radiating portions are adapted to have a shape capable of radiating a circularly-polarized wave.

7. The microwave heating device according to claim 1, wherein the heating-chamber input portion comprises a termination-end closure portion formed in a termination end of the waveguide tube in a microwave propagation direction, and a termination-end radiating portion adapted to direct, to the inside of the heating chamber, microwaves based on a standing wave having an in-tube wavelength which is induced in the termination-end closure portion, and a distance in the microwave propagation direction from the termination-end closure portion to a center of the termination-end radiating portion has a length of an odd multiple of about ¼ the in-tube wavelength in the waveguide tube.

8. The microwave heating device according to claim 1, wherein the heating-chamber input portion comprises a termination-end closure portion formed in a termination end of the waveguide tube in a microwave propagation direction, and a termination-end radiating portion adapted to direct, to the inside of the heating chamber, microwaves based on a standing wave having an oscillation wavelength of the microwave supply portion which is induced in the termination-end closure portion, and a distance in the microwave propagation direction from the termination-end closure portion to a center of the termination-end radiating portion has a length of an odd multiple of about ¼ the oscillation wavelength of the microwave supply portion.

9. The microwave heating device according to claim 7, wherein the termination-end radiating portion is adapted to have a microwave ejecting function for ejecting microwaves propagating through the waveguide tube to the inside of the heating chamber and, also, to perform a function as a microwave radiating portion for heating the object to be heated.

10. The microwave heating device according to claim 2, which is adapted such that an amount of microwaves input to the inside of the heating chamber through the heating-chamber input portion is equal to or less than 10% of a total amount of microwaves radiated to the inside of the heating chamber through the plurality of the microwave radiating portions.

11. The microwave heating device according to claim 2, wherein surfaces forming the heating chamber are adapted such that a surface in which the heating-chamber input portion is placed, and a surface in which the microwave radiating portions are placed, are facing each other.

12. The microwave heating device according to claim 3, wherein surfaces forming the heating chamber are adapted such that a surface in which the heating-chamber input portion is placed, and a surface in which the microwave radiating portions are placed, are facing each other.

13. The microwave heating device according to claim 10, wherein surfaces forming the heating chamber are adapted such that a surface in which the heating-chamber input portion is placed, and a surface in which the microwave radiating portions are placed, are facing each other.

14. The microwave heating device according to claim 2, wherein the heating-chamber input portion comprises a reflective-surface structural portion formed in a termination end of the waveguide tube in a microwave propagation direction, and an inputting opening portion adapted to direct, to the inside of the heating chamber, microwaves having been reflected by the reflective-surface structural portion.

15. The microwave heating device according to claim 3, wherein the heating-chamber input portion comprises a reflective-surface structural portion formed in a termination end of the waveguide tube in a microwave propagation direction, and an inputting opening portion adapted to direct, to the inside of the heating chamber, microwaves having been reflected by the reflective-surface structural portion.

16. The microwave heating device according to claim 2, wherein the microwave radiating portions are adapted to have a shape capable of radiating a circularly-polarized wave.

17. The microwave heating device according to claim 3, wherein the microwave radiating portions are adapted to have a shape capable of radiating a circularly-polarized wave.

18. The microwave heating device according to claim 2, wherein the heating-chamber input portion comprises a termination-end closure portion formed in a termination end of the waveguide tube in a microwave propagation direction, and a termination-end radiating portion adapted to direct, to the inside of the heating chamber, microwaves based on a standing wave having an in-tube wavelength which is induced in the termination-end closure portion, and a distance in the microwave propagation direction from the termination-end closure portion to a center of the termination-end radiating portion has a length of an odd multiple of about ¼ the in-tube wavelength in the waveguide tube.

19. The microwave heating device according to claim 3, wherein the heating-chamber input portion comprises a termination-end closure portion formed in a termination end of the waveguide tube in a microwave propagation direction, and a termination-end radiating portion adapted to direct, to the inside of the heating chamber, microwaves based on a standing wave having an in-tube wavelength which is induced in the termination-end closure portion, and a distance in the microwave propagation direction from the termination-end closure portion to a center of the termination-end radiating portion has a length of an odd multiple of about ¼ the in-tube wavelength in the waveguide tube.

20. The microwave heating device according to claim 2, wherein the heating-chamber input portion comprises a termination-end closure portion formed in a termination end of the waveguide tube in a microwave propagation direction, and a termination-end radiating portion adapted to direct, to the inside of the heating chamber, microwaves based on a standing wave having an oscillation wavelength of the microwave supply portion which is induced in the termination-end closure portion, and a distance in the microwave propagation direction from the termination-end closure portion to a center of the termination-end radiating portion has a length of an odd multiple of about ¼ the oscillation wavelength of the microwave supply portion.

* * * * *